US010314412B2

(12) United States Patent
Turner et al.

(10) Patent No.: US 10,314,412 B2
(45) Date of Patent: Jun. 11, 2019

(54) RETRACTABLE HINGED SHELF DISPLAY

(71) Applicant: Retail Space Solutions LLC, Milwaukee, WI (US)

(72) Inventors: Christopher J. Turner, Pewaukee, WI (US); Craig A. Fluegge, Menomonee Falls, WI (US)

(73) Assignee: Retail Space Solutions LLC, Milwaukee, WI (US)

( * ) Notice: Subject to any disclaimer, the term of this patent is extended or adjusted under 35 U.S.C. 154(b) by 16 days.

(21) Appl. No.: 15/260,647

(22) Filed: Sep. 9, 2016

(65) Prior Publication Data

US 2017/0071364 A1 Mar. 16, 2017

Related U.S. Application Data

(63) Continuation-in-part of application No. 29/554,176, filed on Feb. 9, 2016, now Pat. No. Des. 812,945.

(60) Provisional application No. 62/216,805, filed on Sep. 10, 2015.

(51) Int. Cl.

| | |
|---|---|
| ***A47F 5/00*** | (2006.01) |
| ***A47B 96/02*** | (2006.01) |
| ***A47B 96/06*** | (2006.01) |
| *A47F 5/10* | (2006.01) |

(52) U.S. Cl.

CPC ..... *A47F 5/0093* (2013.01); *A47B 96/028* (2013.01); *A47B 96/061* (2013.01); *A47F 5/0043* (2013.01); *A47F 5/0081* (2013.01); *A47B 96/025* (2013.01); *A47F 5/103* (2013.01)

(58) Field of Classification Search

CPC ..... A47F 5/0081; A47F 5/0093; A47B 96/025

See application file for complete search history.

(56) References Cited

U.S. PATENT DOCUMENTS

| | | | |
|---|---|---|---|
| 3,975,071 | A | 8/1976 | Quinn |
| 4,023,682 | A | 5/1977 | Niece |
| 4,589,349 | A | 5/1986 | Gebhardt |
| 4,620,489 | A | 11/1986 | Albano |
| 4,646,658 | A | 3/1987 | Lee |
| 4,669,692 | A | 6/1987 | Mastrodicasa |
| 4,776,472 | A | 10/1988 | Rosen |
| 4,934,645 | A | 6/1990 | Breslow |

(Continued)

FOREIGN PATENT DOCUMENTS

| | | | | |
|---|---|---|---|---|
| CA | 1037908 | A1 * | 9/1978 | |
| DE | 29605842 | U1 * | 7/1996 | ..... A47B 57/06 |

(Continued)

*Primary Examiner* — Stanton L Krycinski

(74) *Attorney, Agent, or Firm* — Andrus Intellectual Property Law, LLP

(57) ABSTRACT

A hinged drawer type shelving apparatus includes a shelf with a first portion and a second portion hinged to the first portion. The first portion is connected between opposing arms that have a guide connected to a rearward portion of the arm. A frame has opposing side members between which the shelf is disposed. Each side member has a channel for directing or guiding movement of the corresponding guide. The shelf moves between a first stored position, where the first and second shelf portions are coplanar with one another, and a second extended position to facilitate restocking of product. In the extended position, the first shelf portion is tilted and non-coplanar with the second shelf portion.

15 Claims, 15 Drawing Sheets

(56) References Cited

U.S. PATENT DOCUMENTS

| | | | | |
|---|---|---|---|---|
| 5,088,607 | A * | 2/1992 | Risafi | A47B 57/42 211/187 |
| 5,197,610 | A | 3/1993 | Bustos | |
| 5,411,146 | A | 5/1995 | Jarecki | |
| 5,531,159 | A | 7/1996 | Stubblefield | |
| 5,715,957 | A | 2/1998 | Merl | |
| 6,164,462 | A | 12/2000 | Mumford | |
| 6,234,328 | B1 | 5/2001 | Mason | |
| 6,302,282 | B1 | 10/2001 | Gay | |
| 6,357,609 | B1 * | 3/2002 | Van Noord | A47B 45/00 108/65 |
| 6,719,152 | B1 | 4/2004 | Nagel | |
| 6,745,906 | B1 | 6/2004 | Nagel | |
| 6,799,523 | B1 * | 10/2004 | Cunha | A47F 5/0093 108/108 |
| 6,843,382 | B2 | 1/2005 | Kanouchi | |
| 6,866,155 | B2 | 3/2005 | Nagel | |
| 6,866,352 | B2 | 3/2005 | Fujii | |
| 6,886,700 | B2 | 5/2005 | Nagel | |
| 6,889,855 | B2 | 5/2005 | Nagel | |
| 7,048,131 | B2 | 5/2006 | Gay | |
| 7,121,104 | B2 * | 10/2006 | Howington | A47B 57/045 62/256 |
| 7,571,821 | B2 | 8/2009 | Noble Colin | |
| 7,896,171 | B2 | 3/2011 | Battaglia | |
| 7,950,537 | B1 | 5/2011 | Goodman | |
| 8,840,205 | B2 * | 9/2014 | Chellappan | F25D 23/067 108/93 |
| 2002/0027115 | A1 | 3/2002 | Gay | |
| 2003/0136750 | A1 | 7/2003 | Fujii | |
| 2003/0160012 | A1 | 8/2003 | Kanouchi | |
| 2003/0173876 | A1 | 9/2003 | Fujii | |
| 2007/0062891 | A1 * | 3/2007 | Stievenard | A47B 96/025 211/59.2 |
| 2007/0295681 | A1 | 12/2007 | Colin | |
| 2014/0091696 | A1 | 4/2014 | Welker | |
| 2014/0239792 | A1 | 8/2014 | Chellappan | |
| 2016/0088933 | A1 * | 3/2016 | Rossignol | A47B 81/007 312/270.2 |

FOREIGN PATENT DOCUMENTS

| | | | | |
|---|---|---|---|---|
| DE | 10309305 | A1 * | 9/2004 | A47F 5/0093 |
| JP | 2000155869 | A * | 6/2000 | A47F 5/0093 |

* cited by examiner

RETRACTABLE HINGED SHELF DISPLAY

RELATED APPLICATIONS

This application claims priority to U.S. Provisional Patent Application No. 62/216,805, titled "Retractable Hinged Shelf Display," filed on Sep. 10, 2015, and is a continuation-in-part of U.S. Design patent application No. 29/554,176, titled "Shelf Components," filed Feb. 9, 2016, which applications are hereby incorporated herein by reference in their entirety.

TECHNICAL FIELD

The present disclosure generally relates to shelving displays. More specifically, the present disclosure relates to shelving displays with a hinged extendable shelf.

BACKGROUND

Direct store delivery ("DSD") personnel are often tasked with stacking merchandise on shelves in stores. As a part of their tasks, DSD personnel may be asked to stack and front face products on store shelves so that the shelves maintain a fully-stocked appearance. For some products, DSD personnel can spend a considerable amount of time stacking and front facing the products.

For example, DSD personnel can spend seven hours per day, twice a week, or five hours a day three times a week front facing salty snacks such as potato chips, tortilla chips, pretzels, and the like. Stacking and front facing salty snacks can be particularly challenging because store displays often only provide only a small of space between shelves, thereby making it difficult for the DSD personnel to reach and arrange the bags to stand upright in a satisfactory arrangement. Moreover, salty snacks often come in bags and other packaging that can be prone to tipping over and thus be challenging to stack and front face.

SUMMARY

The present disclosure describes various examples of shelving unit that can be used to display merchandisable objects, and related methods of making, using, and installing such a shelving unit. In one example, the apparatus includes a pair of side brackets that are configured to attach to a support structure (e.g., a vertical support structure).

Each side bracket includes a slide channel. The slide channels include a flat portion toward a rear of the side bracket and an angled portion forward from the flat portion. The flat portion fan be generally flat when the side bracket is installed with respect to the support structure, or in other words, the flat portion is generally parallel with the longitudinal axis of the side bracket.

The shelving unit also includes a shelf that slides along the side brackets between a retracted position and an extended position. The shelf includes a rear tray with a support mechanism that supports the rear tray on the side brackets. The rear tray is configured to slide along the pair of side brackets between the open and retracted position. The shelf also includes a front tray hinged to the rear tray.

The front tray has side arms that extend along opposing side edges of the front tray. The side arms extend beyond a rear edge of the front tray so that, when the front tray is parallel with the rear tray, the side arms at least partially overlap the rear tray. The side arms have a sliding mechanism (e.g., a wheel, bearing, bushing, slider, etc.) that can slide within the slide channels of the side brackets. The front tray is hinged so that it can pivot with respect to the rear tray.

The shelf is hinged so that when the shelf is in the retracted position, the front tray and the rear tray are generally parallel, and the sliding mechanisms of the side arms are within the flat portion of the slide channels. When the shelf is in the extended position, the sliding mechanism of the side arms travels into the angled portion of the slide channels, thereby allowing the front tray to pivot with respect to the rear tray. For example, in the extended position, the front tray can pivot downward, thereby facilitating the stacking of product (e.g., salty snacks) on the shelf.

DETAILED DESCRIPTION

Figure 1A:
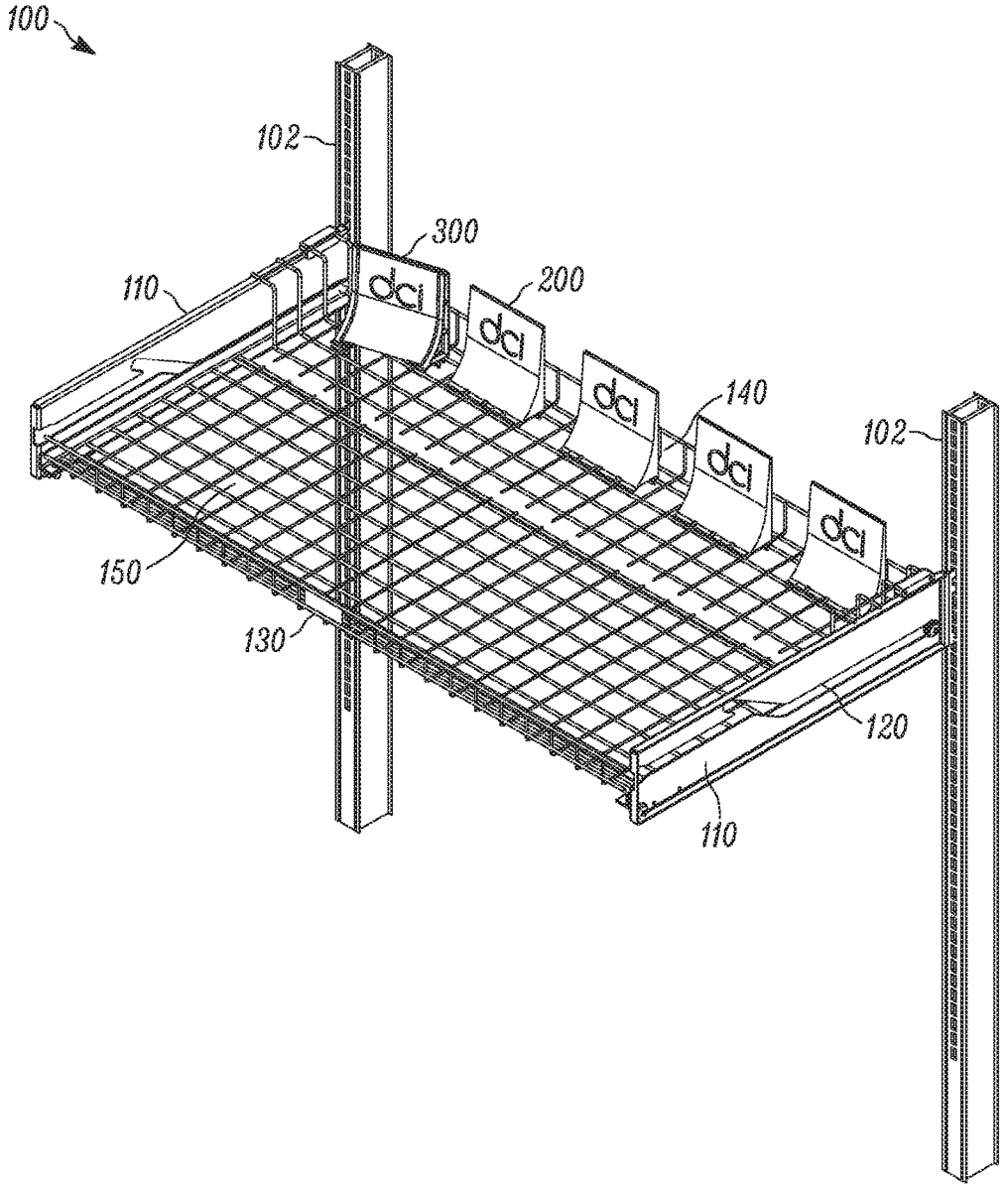
FIG. 1A is an isometric view of a shelving unit in a retracted position in accordance with one or more examples described herein.

The present disclosure describes examples of a shelving system that employ a retractable hinged shelf. The described shelving systems can be particularly useful, for example, in retail environments that display products for sale. In particular, the described shelving systems are useful for the display of salty snacks such as potato chips, pretzels, tortilla chips, popcorn, and the like in grocery stores, supermarkets, convenience stores, or other retail establishments.

The described shelving systems provide a drawer-type extendable and retractable shelf that installs onto side brackets with a channel or channels that facilitate the shelf sliding between the retracted and extended position. In the extended position the shelf can pivot downward so that a user can more easily load product onto the shelf without being inhibited by a shallow head space above the product. The shelf can then be pivoted back upward and returned the retracted position.

The side brackets can also include an installation channel that allows the shelf to be installed and then moved between the retracted and extended position. This installation channel can be configured so that an installed shelf is not inclined to re-enter the installation channel without intended movement and control by a user. In this manner, the shelf can freely move between extended and retracted positions without accidentally or unwantedly un-installing, or otherwise being removed from the shelving system.

The shelf comprises two sections hinged together. A rear section (which can be a basket, a tray, a shelf, etc.) is designed to remain generally parallel with the side brackets of the shelving unit. In this manner the rear portion remains generally flat whether the shelf is in the retracted or extended position. In some examples, the rear portion is designed to remain entirely within the confines of the side bracket while in both the retracted and extended position. That is, the rear portion will not extend beyond the front of the side brackets unless a user intends to remove or uninstall the shelf.

A front portion (e.g., basket, tray, shelf, etc.) is hinged to the rear portion and is designed to pivot downward when the shelf is in the extended position. By pivoting downward the front portion presents a loading surface that is easier for a user (e.g., DSD personnel) to see and load. Part or all of the front portion will generally extend beyond the side brackets in the extended position, thereby pulling the shelf away from other shelves in the shelving unit, and generating headspace and room for the user to load the shelf. In this manner, the shelving system can be particularly useful as a snack shelf, because the hinged section allows the front to tilt down once pulled out from the store shelving while still leaving the rear portion flat so as not to disrupt the spacing between the flat rear portion of the shelf and the shelf above it (i.e., maintaining the interstitial spacing between the shelves).

In some examples, the shelves include a grid of bars or rungs. For example, the display surface of the shelves may include a network of interlocking perpendicular rungs designed to support products of a minimum size (e.g., all products large enough to avoid falling through the shelf between the rungs). In one embodiment, the hinge is made of interlocking hooks and loops formed between the wire rungs of the shelf. The tilting effect occurs when the sliding mechanism attached to side arms of the forward tray (or basket) portion ramp up into an angled portion of the channel defined by the side brackets. This causes the forward tray (or basket) portion to tilt down, making the shelf easier to restock and front face difficult items such as bags. In many instances, the tilting of the shelf actually causes the items to fall forward into the desired orientation.

Some examples described herein may employ an index mechanism to bias the shelf in the closed or retracted position. Such a mechanism can be an index or similar feature toward a rear of the channel in the side bracket that can be overcome by pulling on the shelf to pull it out into its tilted position for restocking and/or re-facing the product. In this manner, the index mechanism can help assure the shelf remains in the retracted position unless and until a user makes a deliberate attempt to pull the product toward the extended position. This can help keep all shelves in a display in line with one another while on display, and inhibit unwanted drifting of the shelves away from the retracted position.

To further assist in keeping the stocked items/products in an upright position, certain embodiments described herein include a snap-in backstop that connects to the tray. For example, the backstop can include a paddle that connects to rungs of the rear tray (or even the front tray if fewer products are to be placed on the shelf). In some retail locations, customer traffic patterns may be known (or generally known) or influenced to travel in a particular direction. In such locations it can be beneficial to partially turn or otherwise arrange certain items on the shelves (which generally face perpendicular to a direction of travel) so that the front face of the product faces the customers walking in the known or influenced travel direction. This can result in a consumer becoming aware of the product and increase the chance that the product will be purchased. For such angled arrangements, the present disclosure provides angled backstops that can be snapped-in to the display such that the engaging surface arranges the products at an angle.

Referring to the drawings, FIG. 1A shows an example of a shelving unit 100 (or a shelving system, display unit, etc.) in a retracted position. The shelving unit 100 comprises a sliding shelf 130 (e.g., a drawer-type sliding shelf) positioned between two side brackets 110 (e.g., brackets, arms, braces, etc.) that connect to a support structure 102 (e.g., support columns, a shelving frame, a support wall, etc.).

In some examples, the support structure 102 includes a frame or other component with vertical columns capable of supporting multiple shelves. The support structure 102 is equipped with one or more connecting mechanisms that allow the side brackets 110 to attach to the structure 102. For example, the support structure 102 can include a series of slots or holes that are configured to attach with corresponding tabs or pegs on the side brackets 110. In this manner the attached side brackets 110 can extend perpendicular to the support structure with integrity to support the shelf 130 installed there between.

In some examples, the support structure 102 includes several connecting mechanisms so that the shelving unit can support a plurality of shelves. Further, the connecting mechanisms also provide a level of adjustability for the shelving unit 100 in that it allows for the heights of the shelves to be raised or lowered as desired, by placing the side brackets 110 into higher or lower located connecting mechanisms.

The shelf 130 is arranged so that it can slide horizontally with respect to the side brackets between a retracted position (shown, e.g., in FIGS. 1A, 1B, and 1D) and an extended position (shown, e.g., in FIGS. 1C, 1E, 1G, and 1I). The shelf 130 can rest upon and/or slide on upper or lower surfaces of the side brackets 110.

The side brackets 110 each have a channel 120 that helps guide the shelf as it slides between the retracted and extended position. The channel 120 can also include an insertion portion that allows the shelf to be installed and/or removed with respect to the side brackets.

In some examples, the shelf itself 130 comprises two sections. A rear section, or rear tray 140 (or a rear basket, rear platform, rear shelf, etc.), is positioned at the rear of the shelf 130, or closer to the support structures 102. A front section, or front tray 150, (or a front basket, front platform, front shelf, etc.) is positioned forward of the rear section, and can be hinged to the rear tray 140 so that the front tray 150 can pivot vertically with respect to the rear tray 140. In this manner, the rear tray 140 can be configured to slide only horizontally (or otherwise parallel with the side brackets 110), where the front tray 150 can slide horizontally and then pivot vertically while in the extended position.

FIG. 1A also shows a plurality of backstops 200 and 300 positioned on the rear tray 140 of the shelf 130. The backstops can be employed to facilitate products stacked on the display to stand upright. For example, where the products are bags (e.g., bags of chips) or other products that tend to tip over easily, the backstop can facilitate the bags to remain upright during loading and/or while on display.

The backstops 200 include several forward facing backstops 200 and one angled backstop 300, which has an engaging surface that is angled with respect to the shelving unit 100. That is, the engaging surface of the angled backstop 300 is neither parallel with the front/rear edges nor the side edges of the shelf 130. In this manner, the angled backstop facilitate products to stack at an angle with respect to the shelving unit 100 so that the stacked products can face consumers walking down an aisle.

Figure 1B:
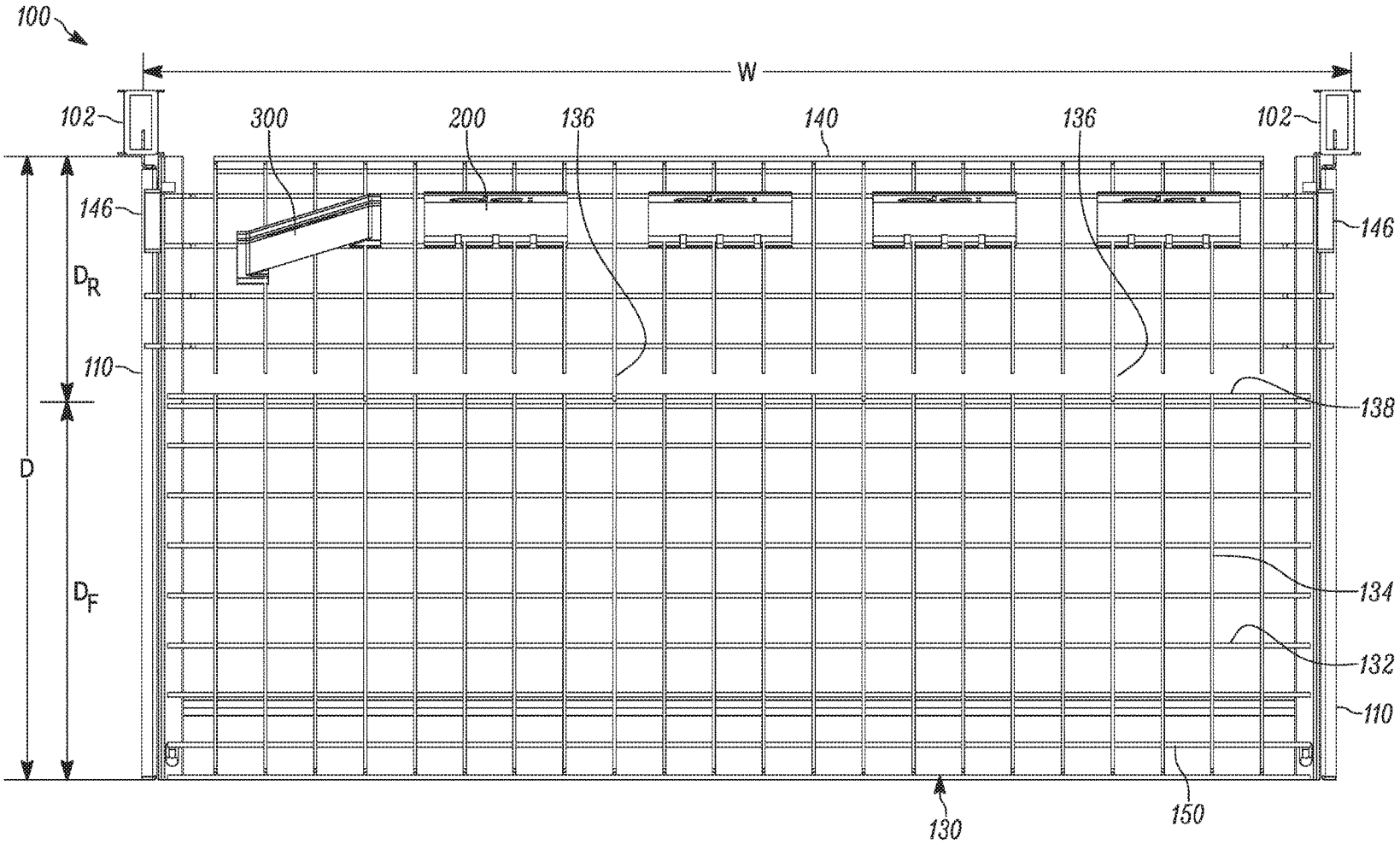
FIG. 1B is a top view of the shelving unit of FIG. 1A in a retracted position.

FIG. 1B is a top view of the shelving unit 100, still in the retracted position. As seen from above, the resting surface of the shelf comprises a grid of interlocked bars, for example, a series of longitudinal (front-to-back) rungs 134 arranged on top of a series of transverse (side-to-side) rungs 132 to establish the surface. The rungs can be arranged so that the first series of rungs (e.g., the front-to-back rungs) are perpendicular or generally perpendicular to the second series of rungs (e.g., the side to side rungs). In this manner, the rungs can facilitate objects, such as backstops 200, 300, attaching to the shelves.

In some examples, the rear tray 140 and the front tray 150 of the shelf 130 comprise a solid support surface. For example, the resting surface of the tray can include a solid sheet of metal, plastic, wood. In some examples, the resting surfaces can be perforated or otherwise not completely solid. The solid or partially solid support surface can be equipped with attachment mechanisms (e.g., holes, slots, grooves, tabs, clips, etc.) that allow objects, such as backstops 200, 300. To attach to the shelf 130. In some examples, the front tray 150 and the rear tray 140 may comprise different support surfaces. For example, in some embodiments the front tray can include a solid support surface whereas the rear tray includes a grid of rungs as a support surface, or vice versa.

As noted, some embodiments of the shelf 130 comprise a front tray 150 hinged to a rear tray 140. FIG. 1B shows that the rear tray 140 of the shelf 130 has a depth $D_R$, and the front tray has a depth $D_F$. Together the front tray and rear tray combine to establish a total depth D of the shelf 130. The shape, size and configurations of the two trays can vary depending on the intended use of the shelving system. For example, the shelf can be configured so that at least one third of the shelf remains supported by the side brackets even in the extended position. In this manner, the $D_R$ will be about half that of $D_F$, or about one third that of D. In other embodiments the depth $D_R$ may be larger or smaller than one third the depth of the entire shelf, depending on a variety of factors including but not limited to, the width W of the shelf, the weight that the shelf 130, the weight that the shelf 130 is designed to hold, the type of product stacked on the shelf, and the spacing height between successive shelves 130 on a shelving unit 100.

Figure 1C:
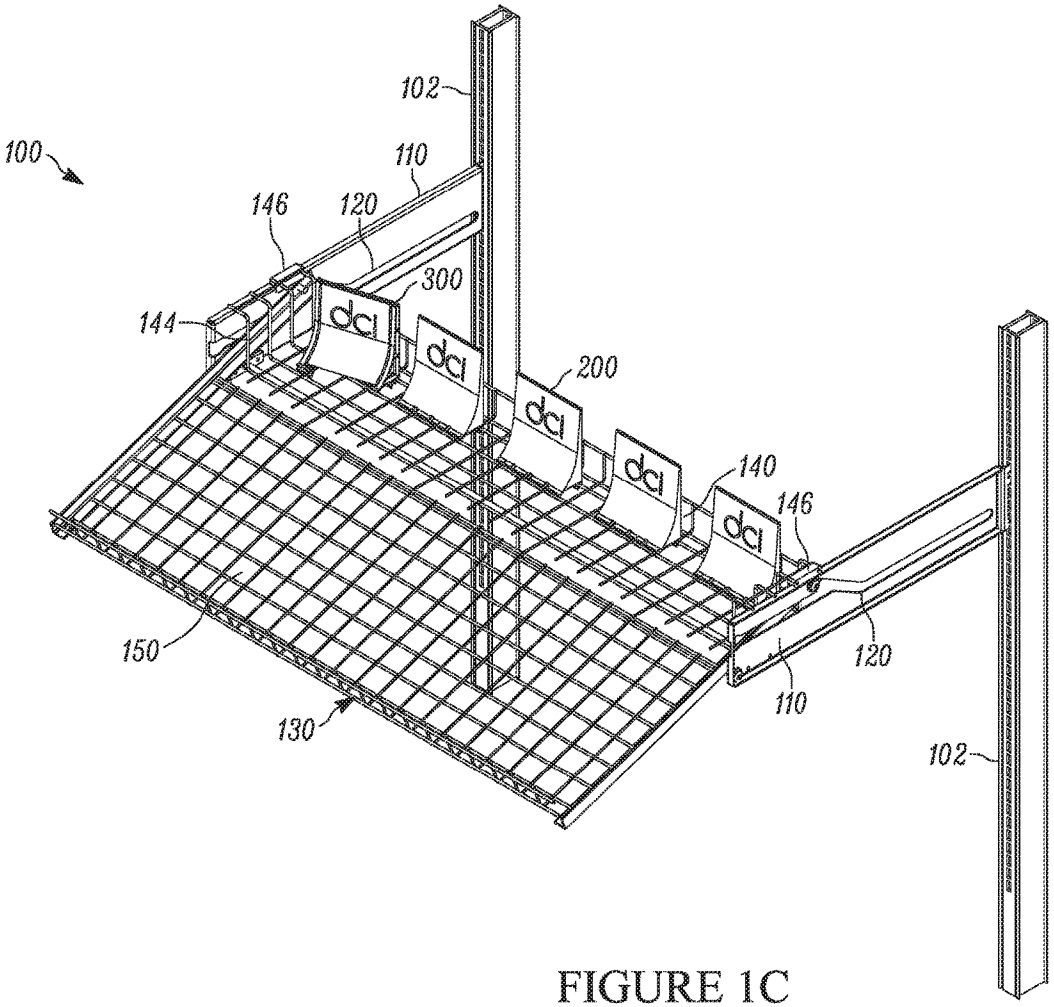
FIG. 1C is an isometric view showing the shelving unit of FIG. 1A in an extended position.
Figure 1D:
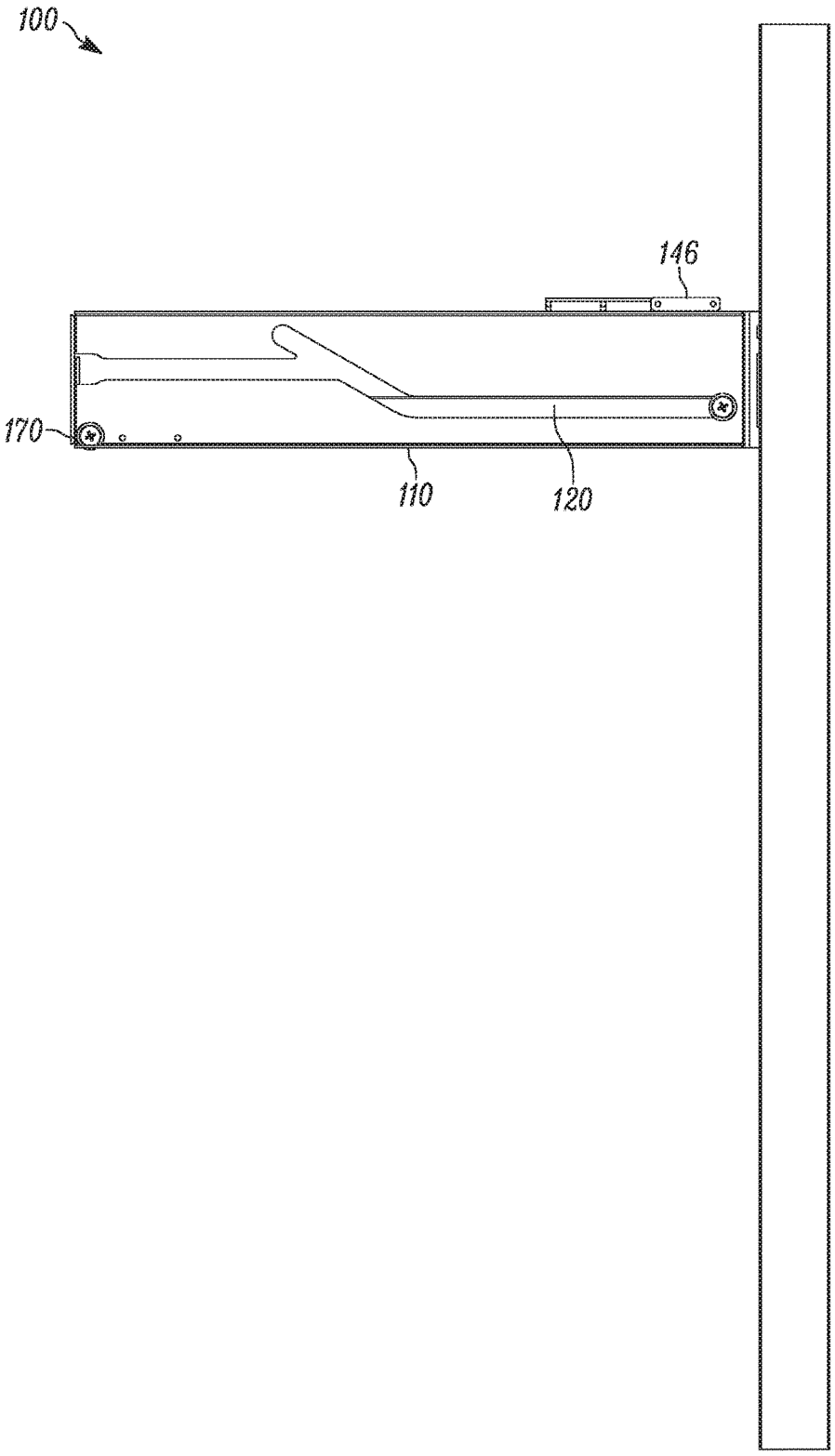
FIG. 1D is a side elevation view of the shelving unit of FIG. 1A in a retracted position.
Figure 1E:
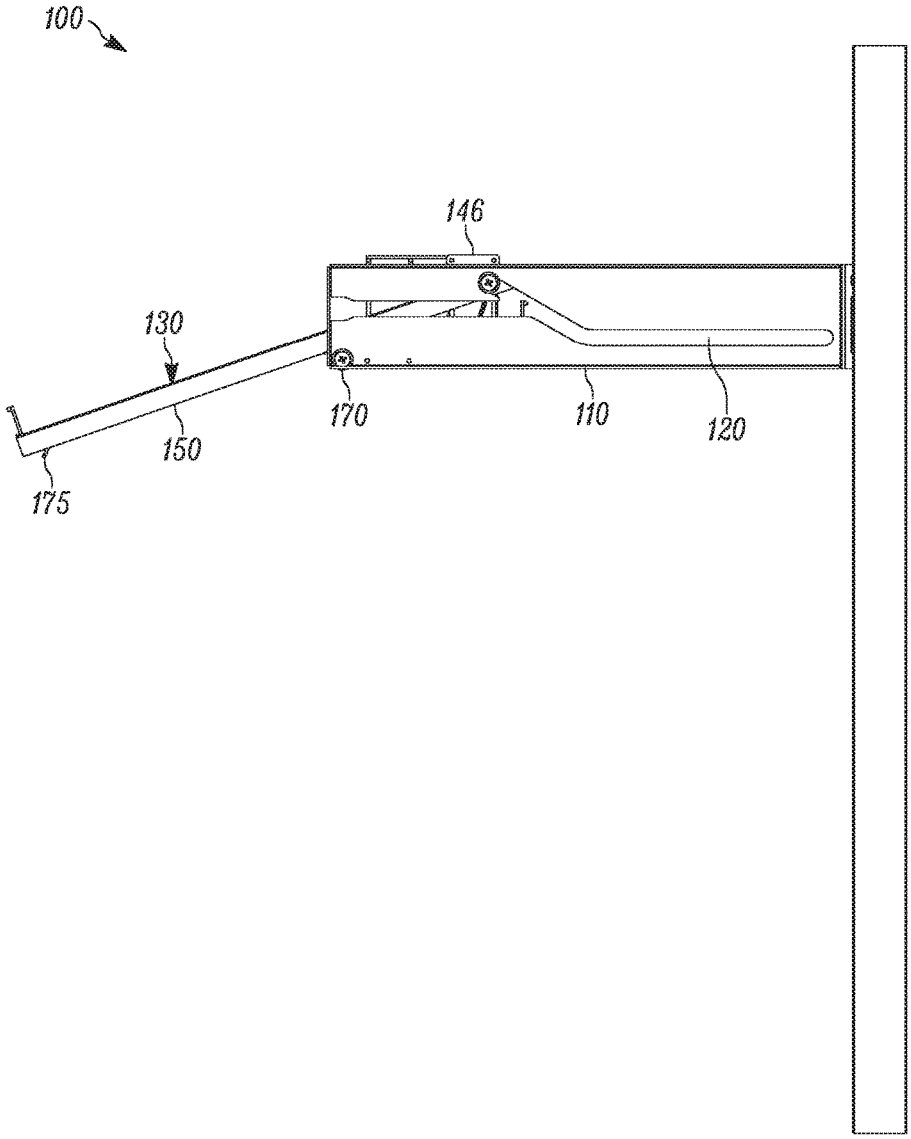
FIG. 1E is a side elevation view of the shelving unit of FIG. 1A in an extended position.

As noted, the shelf 130 can slide between the retracted position and the extended position. FIG. 1C shows the shelving unit 100 an extended position. FIGS. 1D and 1E are side elevation views of the shelving unit 100 and showing the shelf 130 in the retracted position (FIG. 1D) and in the extended position (FIG. 1E). As seen in FIGS. 1C and 1E, in the extended position, the front tray 150 can pivot vertically with respect to the rear tray 140. In this manner the front tray 150 can angle downward to present a more easily stackable surface.

FIGS. 1D and 1E also show that the side bracket 110 serves as a support for the shelf 130 to slide between the retracted and extended positions. In some examples, the shelf 130 is supported on the side bracket via the channel 120, and via a support mechanism 146 that rests upon the side bracket 110. The support mechanism 146 can be a component of the rear tray 140. For example, the support mechanism 146 can be an extension of a side wall 144 that extends up from a surface 147 of the rear tray 140. The shelf 130 may also be supported by a support mechanism 170 (e.g., a friction reducing mechanism on a support brace, bar, rod, etc.) that extends between the two side brackets 110 of the shelving unit.

Figure 1F:
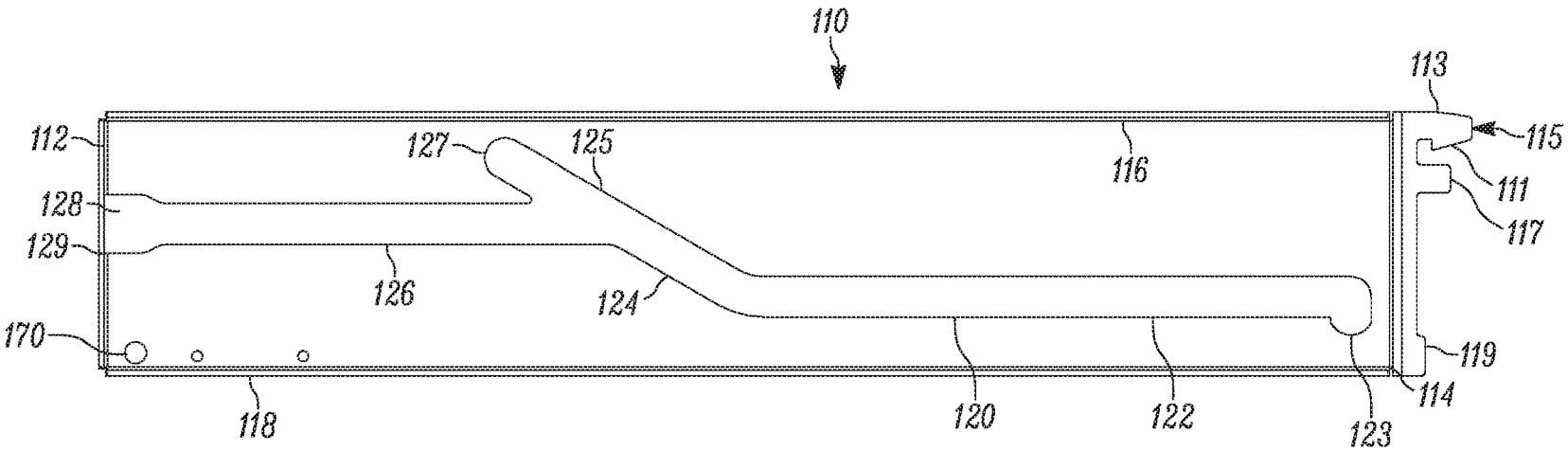
FIG. 1F shows a side bracket component of the shelving unit of FIG. 1A.

FIG. 1F is a close up of a side bracket 110, in particular, side bracket 110 on the right side of the shelf (viewed looking at the shelf from the vantage of FIG. 1A), removed from the shelving unit 100. For reference purposes, the left side bracket 110 includes a front portion 112, a rear portion 114, an upper edge 116 and a lower edge 118.

Extending from rear edge 114 is a mounting mechanism 115, which can be a hanging mechanism, securing mechanism, attaching mechanism, interlocking mechanism, or the like. In some examples, the mounting mechanism 115 is configured to connect with one or more connection mechanisms of the support structure 102 of the shelving unit 100. As shown here, the mounting mechanism 115 includes two tabs 113, 117 that are configured to insert into corresponding slots of the support structure 102. The upper tab 113 is a notched tabs that includes a tooth or a notch 111. Via this configuration the mounting mechanism can provide three or more points of contact with the support structure 102. For example, the lower tab 117 and the upper tab 113 each provide two or more points of vertical support, which keeps the bracket up 110 and also inhibits the bracket 110 from rotating with respect to the shelving unit 100. The notch 111 provides a lateral support and inhibits the bracket 110 from falling out of the corresponding slots, or otherwise accidentally being removed from the support structure 102. In some aspects, the mounting mechanism can include a further tab, protrusion, indention, notch, or other structure 119 toward the lower end 118 of the rear side 114 of the bracket 110 that is configured to engage with corresponding a portion of the support structure to further secure and mount the bracket 110 to the support structure 102.

As noted, the side bracket 110 can supports the shelf 130 and facilitate the shelf 130 sliding between the retracted and extended positions. As a part of this support, the upper edge 116 of the bracket 110 can support a support mechanism 146 of the shelf 130. In some examples, the upper edge 116 includes a flat surface. The flat surface can be formed, for example, via a 90 degree bend in the bracket material. This flat surface can provide structural strength and integrity to the bracket 110, while also providing a lower-friction surface that facilitates the shelf to slide smoother along the bracket 110.

In some examples, the shelf 130 is installable with respect to the shelving unit 100 so that the rear tray 140 is supported by the upper surface of the side brackets 110 without any portion of the rear tray 140 entering or being positioned within the channel 120 of the side bracket 100. That is, while the front tray 150 of the shelf 130 may be supported via the channel 120, the rear portion 140 can be entirely supported via the support mechanism 146 resting and sliding on the upper edge 116 of the bracket 110. Such a configuration allows can facilitate construction, assembly, and operation of the shelving unit 100.

The support mechanism 146 can take on a variety of shapes, configurations, or applications. For example, the support mechanism 146 can be a flat nylon bushing (e.g., as shown in the present figures) attached to the bars of the rear tray 140, and that provides a flat, friction reducing sliding surface between the rear tray 140 and the upper edge 116 of the side bracket 110. The bushing of the support mechanism 146 can allow the rear tray 140 to snap on and rest on the side brackets 110. The support mechanism 146 can also be or include a track or groove in the upper edge 116 of the side bracket 110, and/or a corresponding sliding structure extending from the upper portion of the side wall 144 of the rear tray 140. In certain aspects, the support mechanism includes one or more rotatable bushings, bearings, or wheels configured to roll along the upper edge 116 of the side bracket 110. In some configurations, the support mechanism can include an H-channel configured to straddle the upper edge 116 of the side bracket 110 to provide lateral support while also providing a smooth surface for the rear tray 140 to slide. In still other embodiments, the support mechanism 146 can be nothing more than an extension of the rear tray 140 itself. For example, the support mechanism 146 can be rungs or another protrusion that extends from the side walls 144 of the rear tray 140 to rest and slide upon the upper edge 116 of the side brackets 110.

In some examples, the lower edge of the side bracket 110 also includes a flat surface to provide structural integrity and/or to provide another surface to support the sliding of the shelf 130. For example, in some examples (not shown) the tray may comprise a further sliding mechanism (e.g., a roller wheel, slider, bearing, bushing, etc.) is configured to rest and slide upon the flat, lower edge 118 of the side bracket 110.

FIG. 1F provides detail regarding the shape and structure of the channel 120 of the side bracket 110. Starting from the front edge 112 of the side bracket, the channel 120 includes an opening 128 that leads to an insertion portion 126 of the channel 120. This opening 128 is configured to allow the side bracket 110 to receive a portion of the shelf 130 to enter the channel 120 and therefore install into the shelving unit 120. In some examples, the opening 128 can include a notch 129, lip, edge, bump or other mechanism within the opening to inhibit the rear of the shelf 130 from sliding out or accidentally being removed from the retracted position (or to inhibit the rear of the shelf 130 from accidentally dropping from the bracket 110 upon removal of the shelf 130). In this manner, a user can slightly lift the shelf 130 over the notch 129 to remove the shelf from the retracted position. Additionally and/or alternatively, the shelving unit 100 may include other biasing mechanisms (described in more detail below) that bias the shelf 130 in the retracted position, including an index portion 123 of the channel 120, or a mechanism 170 and/or a protruding finger 175 extending from the bottom of the front tray 150.

To the right of the insertion passage 126 is a non-linear rear passage 124. The rear passage 124 defines a non-linear channel comprising an angled portion 125 and a flat portion 122. While referred to as "flat," it is intended that certain examples of the flat portion 122 will be generally linear and parallel with the longitudinal axis. That is, provided that the flat portion 122 enables the rear tray 140 to slide generally parallel with respect to the side brackets 110, the overall "flatness" of the channel is not necessarily significant in all embodiments. The angled portion 125 comprises an angled end stop 127 upon which a portion of the shelf 130 (e.g., sliding mechanism 162 of the side arm 160 of the front tray 150) situates while the shelf 130 is in the extended portion.

In some examples, an index 123 is positioned toward the rear of the rear passage 124. The index 123 can be a groove, divot, recess, notch, bump, or other biasing mechanism configured to bias the shelf 130 in the retracted position. In this manner, when the shelf 130 is returned to the retracted position, the shelf will generally remain there unless and until an intentional attempt is made to pull the shelf 130 toward the extended position (or to remove the shelf). For example, the index 123 can be configured to require a minimum force to remove the shelf 130 from the index 123, where the minimum force is greater than incidental forces that may be caused by consumers removing product from the shelf. In some examples, the index is configured to require a slight vertical lift to remove the shelf 130 from the retracted position. By some approaches the index 123 also provides tactile feedback that the shelf 130 has been fully returned to the retracted position.

In some forms, the shelving unit 100 also includes a friction reducing support mechanism 170 positioned at the lower front corner of the side brackets 110. The friction reducing support mechanism 170 (shown more clearly in FIG. 1G) provides a support structure upon which the shelf 130, in particular the front tray 150 of the shelf 130, can rest and slide upon. The friction reducing support mechanism 170 can take on a variety of shapes and/or configurations. For example, the friction reducing mechanism can be a roller, a wheel, a slider, a bushing, a ledge, a bar, or the like.

In some aspects, the friction reducing support mechanism 170 can be a roller or bushing and may be made of low friction material. Additionally and/or alternatively, the friction reducing support mechanism 170 may be made of a vibration damping material to serve as a vibration isolator and reduce noise associated with the operation of the shelving apparatus (e.g., reduce noise as shelf moves between first and second positions).

In some aspects the friction reducing support mechanism 170 can serve as a biasing mechanism, or a component of a biasing mechanism that works in conjunction with other components of the shelving unit 100 to facilitate biasing the shelf in the retracted position. For example, the friction reducing support mechanism 170 can operate in connection with a finger 175, or other protrusion extending from a lower surface of a front portion 152 of the front tray to bias the shelf 130 in the retracted position.

Figure 1G:
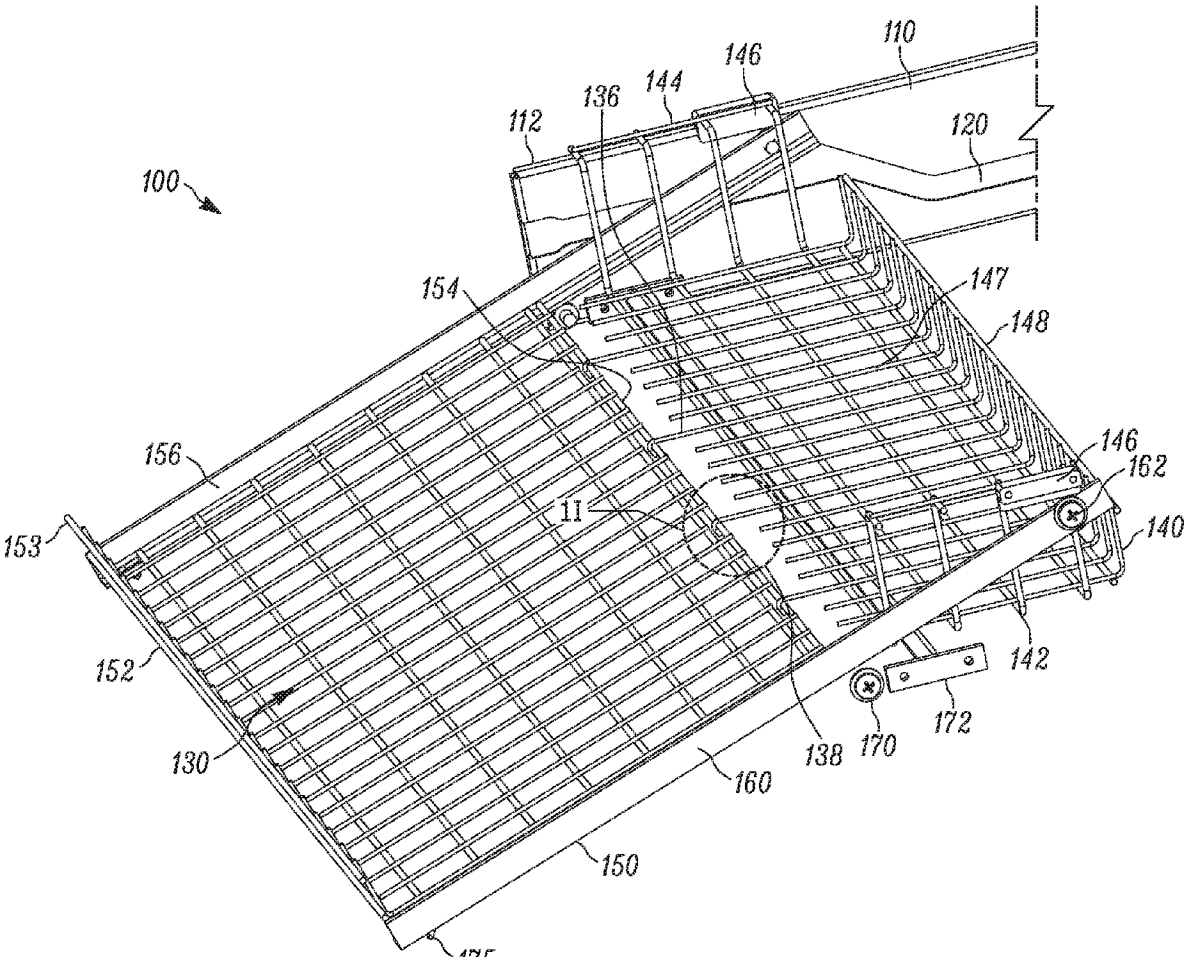
FIG. 1G shows of the shelving unit of FIG. 1A in an extended position with the near side bracket removed from view.

As shown in FIG. 1G, the finger 175 is ramped away from the rear of the shelf 130 so that removing the shelf 130 from the retracted position may involve lifting the front portion 152 of the front tray 150 slightly to lift the finger 175 off the friction reducing support mechanism, or roller 170. The angle of the ramped finger 175 also facilitates returning the shelf 130 to the retracted position, as the roller 170 can roll up the ramped portion of until the finger falls back in place secured behind the roller 170 in the retracted position.

In some examples, the finger defines a stop protruding from a surface of the front tray 150 and is configured to engage with the roller 170 positioned proximate the forward end 112 of the side bracket 110 to hinder inadvertent movement of the shelf 130 from the retracted position to the extended position. In some examples, roller 170 is rotatable with respect to the side bracket 110 and rotates as the finger 175 (or arm, peg, protrusion, ramp, etc.) rides on top of the roller 170 to assist movement of the arm finger 175 along the side bracket 110.

FIG. 1G shows the shelf 130 in the extended position with the near side bracket 110 removed from view for demonstrative purposes. In the extended position, the front portion 150 of the tray is tilted with respect to the rear portion 140.

The front tray 150 may include a lip 153 along the front edge 152 that helps keep products on the shelf 130 during loading and other times. The shelving unit 100 may include a horizontal brace 172 that connects the pair of side brackets 110 and also provides a vertical support to the shelf 130. The front tray 150 may rest and/or slide along this front brace 172 while in the extended position and/or while travelling between the retracted and extended positions.

A pair of side arms 160 extend along the side edges 156 of the front tray. As shown in FIG. 1G, the side arms 160 extend past the rear edge 154 of the front tray such that the side arms 160 extend over the rear tray 140. In the retracted position (e.g., where the front tray 150 and rear tray 140 are generally co-planar), the side arms 160 would overlap with the rear tray 140.

A portion of the side arms 160 may be supported by the support roller 170 as the shelf 130 travels between the retracted and extended positions. For example, a lower edge of each side arm 160 may roll along on the roller 170 to facilitate smooth movement of the shelf 130 along the side brackets 110.

Figure 1H:
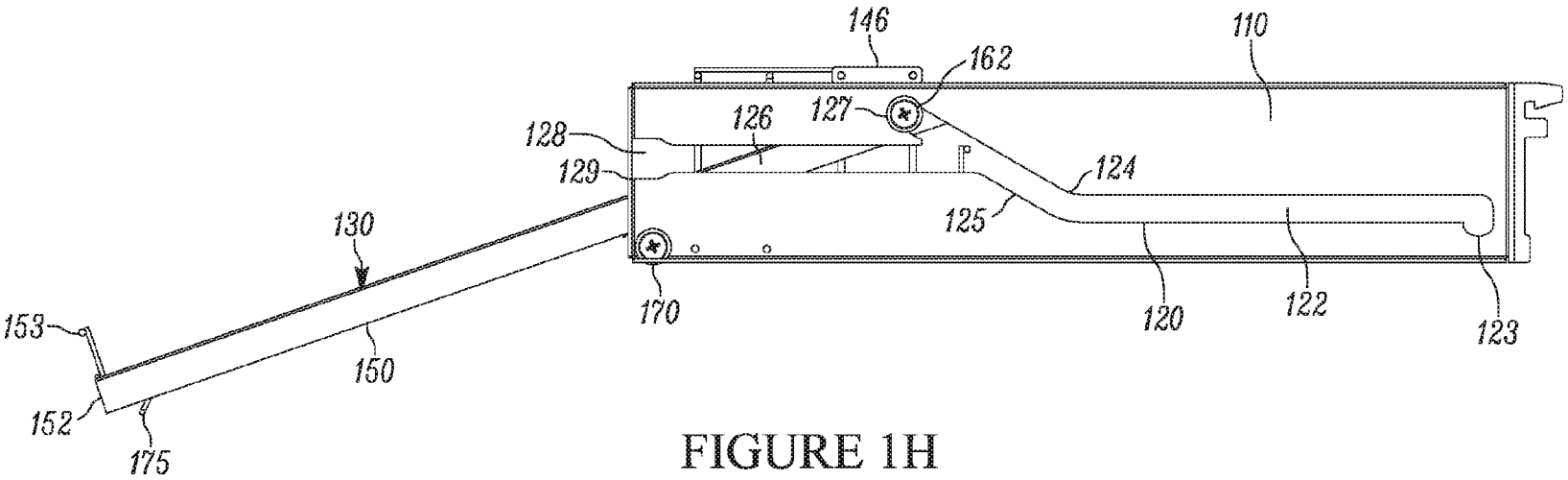
FIG. 1H shows a close up view of the side arm and shelf components of the shelving unit FIG. 1A in an extended position.
Figure 1I:
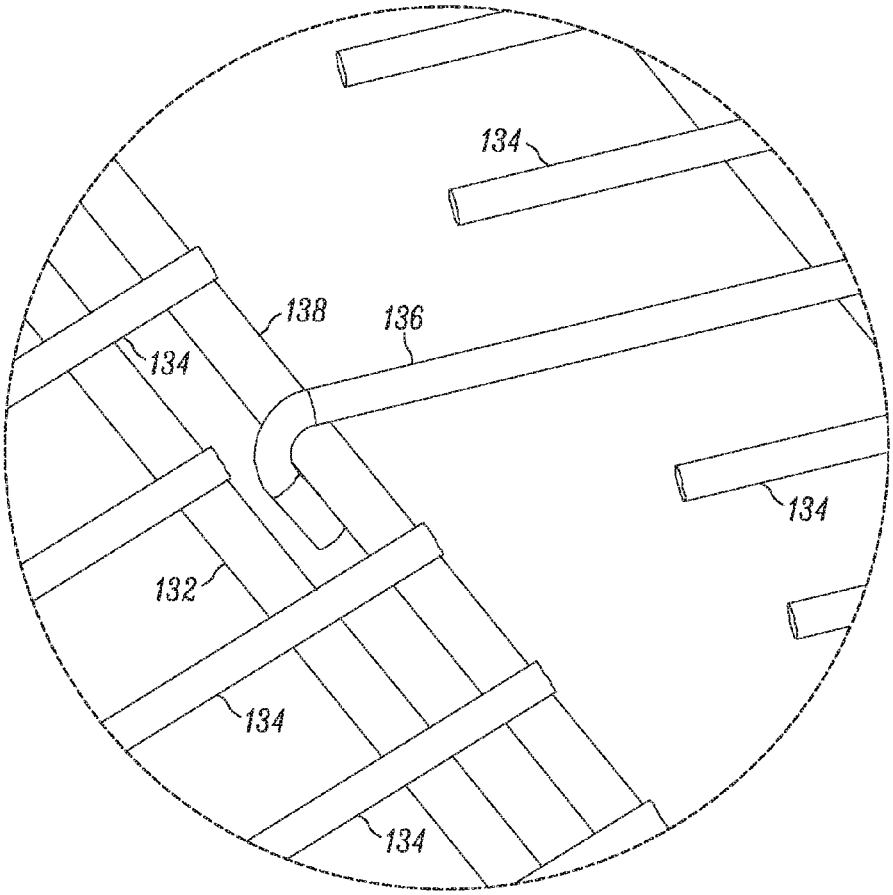
FIG. 1I shows a close up view of a hook hinge component of the shelving unit of FIG. 1A.

Each arm also includes a sliding mechanism 162 toward the rear of the side arms 160. The sliding mechanism can include a wheel, a roller, a rotating bushing, a peg, or other similar device capable of traveling along the channel 120 of the side arm. As shown in FIG. 1H, which is a close up side view of the shelving unit 100 in the extended position, the sliding mechanism 162 is configured to travel and/or slide within the channel 120 of the side arm. In some examples, the sliding mechanism 162 is configured to be inserted into the opening 128 of the insertion passage 126 during installation, and can thereby travel along the insertion passageway 126 into the rear passageway 124, and thereby travel between the retracted and extended positions.

In the retracted position, the sliding mechanism 162 will be in the flat portion 122 of the channel. In particular, the sliding mechanism will be situated within the index 123 so as to bias within the retracted position. Upon removal from the retracted position (which may involve a slight lift or tug on the part of the user to remove the shelf from the index and/or other biasing mechanisms), the sliding mechanism 162 will slide forward along the rear passage 124 toward the angled portion 125 until it reaches the end stop 127 of the angled portion 125 of the rear passage 124 of the channel 120.

While the sliding mechanism 162 is in the angled portion 125, and in particular, at the stop end 127 of the angled portion 125, the shelf 130 will be in the extended position. As the stop end 127 is elevated above the flat portion 122 of the rear passage 124, the front tray 150 will tilt downward from the rear tray 140 in the elevated position. However, because the side arms 160 extend beyond the rear edge 154 of the front tray 150, the rear edge 154 of the front tray 150 can remain hinged to the rear tray 140. That is, even though the side arms elevate while in the angled passageway 125, the portion of the front tray 150 hinged to the rear tray 140 does not change in elevation.

As seen in FIG. 1H, the insertion passageway 126 can be at a different (e.g., a higher) elevation from the rear passageway 124, or at least the flat portion 122 of the rear passageway 124. In this manner, the configuration inhibits the accidental removal of the shelf 130 from the shelving unit 100. That is, the arrangement of the channel 120 is such that the sliding mechanism 162 of the side arms 160 are guided to pass over the insertion channel while traveling along the angled portion 125 of the rear passage 124. However, should a user desire to actually remove the shelf 130, the sliding mechanism 162 can be guided into the insertion passageway 126, and thereby removed through the opening 128. In some aspects the front tray 150 is hinged to the rear tray 140 so that the front tray 150 can pivot downward in the extended position. In one example, the front tray 150 is hinged by way of a hook hinge, as shown in FIG. 1G, and in more detail in FIG. 1I, which is a close up view of the area identified as 1I in FIG. 1G.

As noted above, in some embodiments the shelf 130 is composed of a grid of intersecting rungs 134, 136. In some examples, the hinge is formed via a hook 136 that extends from a longitudinal rung 134 of the rear tray 140 and grabs a bar 138 of the front tray 150. In certain aspects, the bar 138 is the rear-most lateral rung 132 of the front tray 150. It should be noted that while the hinge is shown as a hook 136 extending from the rear tray 140 to grab a bar 138 on the front tray 150, the opposite arrangement could also be effective. That is, the hook 136 could extend from a rung 134 of the front tray 150 and grab a bar 138 on the front of the rear tray 140. In some aspects, the hook 136 is an open channel hook that defines an opening having a center axis that extends perpendicular to the side brackets 110, or otherwise parallel to the bar 138. In this manner, the hook 136 can latch onto the bar 138 and allow the bar 138 to rotate/pivot with respect to the hook 136, thereby establishing a hinge effect.

In operation, examples of the described shelving system can be installed by and operated by way of the following example. Side brackets 110 are connected to a support structure 102 such as a vertical support column or a shelving frame assembly.

A shelf 130 is then installed into the shelving unit 100 by inserting sliding mechanisms 162 on the ends of side arms 160 of the front tray 150 into an opening 128 in a channel 120 in the side brackets 110. The sliding mechanisms 162 thus slide through the insertion passageway 126 and into a separate (though connected) sliding channel/passageway 124. The sliding mechanisms 162 slide through a flat portion 122 of the sliding passageway 124 and come to rest in a rut or index 123, indicating the shelf 130 is fully installed in the retracted position.

When a user wishes to load the shelf 130, the user can lift and/or tug the shelf 130 forward, removing the sliding mechanisms 162 from the index 162, or otherwise disengaging any other biasing mechanisms (e.g., the roller 170 and finger 175 mechanism). As the shelf 130 pulls forward, the sliding mechanism 162 travels into an angled portion 125 of the sliding passageway 124 toward an end stop 127 thereby establishing the shelf in the extended position.

In the extended position the front tray 150 of the shelf 130 is pivoted downward via a hinged section, thereby presenting a shelf surface that may be easier to load. After loading the shelf 130, the user then lifts the front tray 150 to level with the rear tray 140 (which causes the sliding mechanism 162 to travel back down the angled portion 125 of the sliding passageway 124) and then pushes the shelf 130 rearward until the shelf biases in the retracted position.

As shown in FIGS. 1A-1C, the shelving unit 100 can be configured to operate in connection with one or more backstops 200, 300 or paddles. The backstops 200, 300 can facilitate products to stand upright and to face forward. The backstops 200, 300 can be configured to connect or otherwise attach to the shelf 130.

Figure 2:
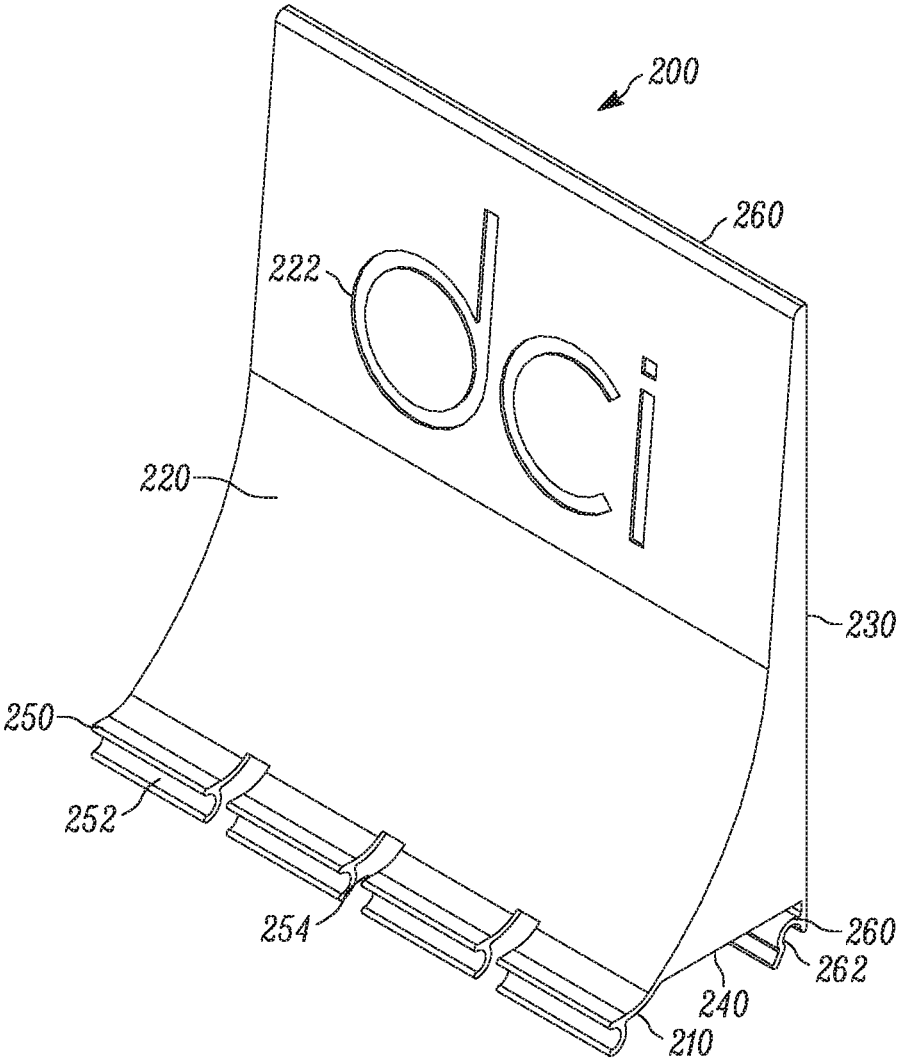
FIG. 2 shows a backstop in accordance with one or more examples described herein.

FIG. 2 shows an example of a backstop 200 configured to connect to a shelf that includes a grid of rungs as a base to the shelf. The backstop includes an engaging surface 220 (e.g., a product engaging surface) at a front portion 210 of the backstop 200, and a rear surface 230. In the example of FIG. 2, the engaging surface 220 is solid and slightly curved, forming a scoop that defines a wider base 240 and a narrower top 260. In other embodiments, the backstop can define a straight surface that either angles rearward, or that doesn't angle and forms a generally vertical surface that has the same width at the top as well as the base 240. In some examples, the engaging surface 220 can be indexed, scored, or otherwise marked with indicia 222 such as lines, labels, or other markings.

A series of front connectors 250 are positioned along the front portion 210 of the base 240. The front connectors 250 include generally forward facing openings 252. These forward facing openings are configured to connect to a portion of the shelf 130, for example, a rung, or in particular, a lateral rung 132 of the shelf 130. The forward facing openings can have a bell mouth configuration that facilitates a snap-fit attachment to the rungs 132. In some configurations the forward facing opening 252 can include a beveled opening, a tapered opening, a friction fit opening, or the like.

The forward facing openings 252 are configured to allow the front portion 210 of the backstop to be tilted forward (e.g., so the rear portion 230 of the base 240 is elevated above the connecting surface of the shelf 130) while snapping into place, and then rotating about the point of connection. In this manner the rear connectors 260 can be pressed down onto corresponding components of the shelf 130 after the front portion 210 of the backstop 200 is attached.

The backstop may include a series of recesses 254 between each of the connectors 250 that receive longitudinal rungs 134 of the shelf 130. In this manner, the connectors 250 can straddle the longitudinal rungs 134 that intersect the lateral rungs 132 to which the connectors 250 are attached.

In some formats, a series of rear connectors 260 are positioned along a rear edge of the base 240 of the backstop 200. The rear connectors can include openings 262 that generally open downward. In some forms, the openings 260 face directly downward (or nearly directly downward). In this manner, the openings 262 can be configured to snap onto corresponding rungs of the shelf 132 as the backstop 230 pivots downward about the forward facing openings 252 of the already-attached front connectors 250. Like the front connectors 250, the openings 262 of the rear connectors 260 can be bell mouthed, tapered, beveled, friction fit, etc. to facilitate connection and detachment from the shelf 130.

To remove the backstop, the rear portion 230 can be tilted up and away from the connecting surface of the shelf 130 by rotating the backstop 200 about the front connectors 250 until the rear connectors 260 detach from the shelf 130, at which point the front connectors 250 can then be detached by lifting upward on the backstop 200.

In some examples, the backstop can be angled, or have an angled surface that facilitates fronting product at an angle with respect to the shelf 130, the support structure 102, and/or the shelving unit 100. That is, the backstop can be angled so as to front the products in a way that turns the front of the products toward consumers that may walk in a direction generally parallel to the shelving unit.

Figure 3:
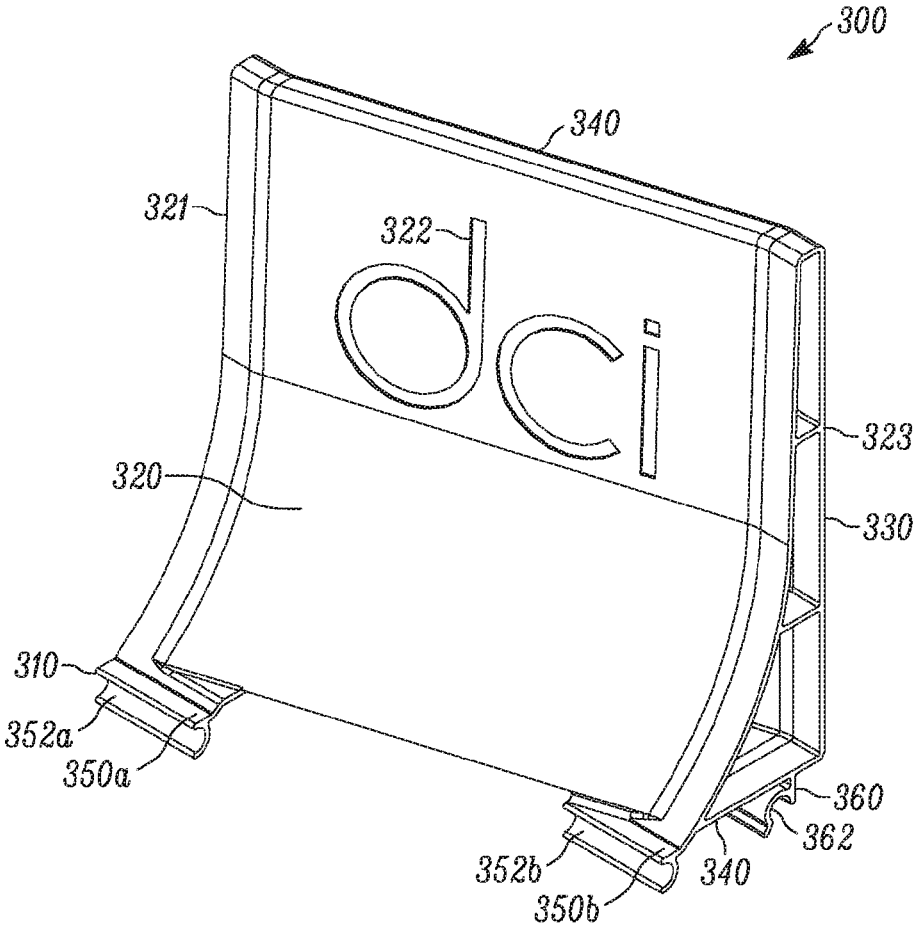
FIG. 3 shows a backstop with an angled engaging surface in accordance with one or more examples described herein.

FIG. 3 shows a backstop 300 with such an angled configuration. The angled backstop 300 is configured generally in a similar manner to backstop 200 of FIG. 2, with the exception that the engaging surface 300 is angled with respect to the engaging surface 220 of a straight backstop 200. For example, the engaging surface 320 can be angled so that a left side 321 of the engaging surface 320 is forward of a right side 323 of the engaging surface 320.

In such a configuration, the backstop 300 may have some front connectors that are forward of other front connectors. For example, a first front connector 352*a* on the left side 321 of the backstop 300 with a forward facing opening 352*a* can be forward of a second front connector 350*b* with a second forward facing opening 352*b* on the right side 323 of the backstop 300. In some examples, the longitudinal distance between the first front connector 350*a* and the second front connector 350*b* is such that each connector can attach to a separate lateral rung 132 among the grid of rungs on the shelf 130. In other embodiments, the spacing may be such that only one connector (350*a* or 350*b*) can attach to a rung.

Figure 4:
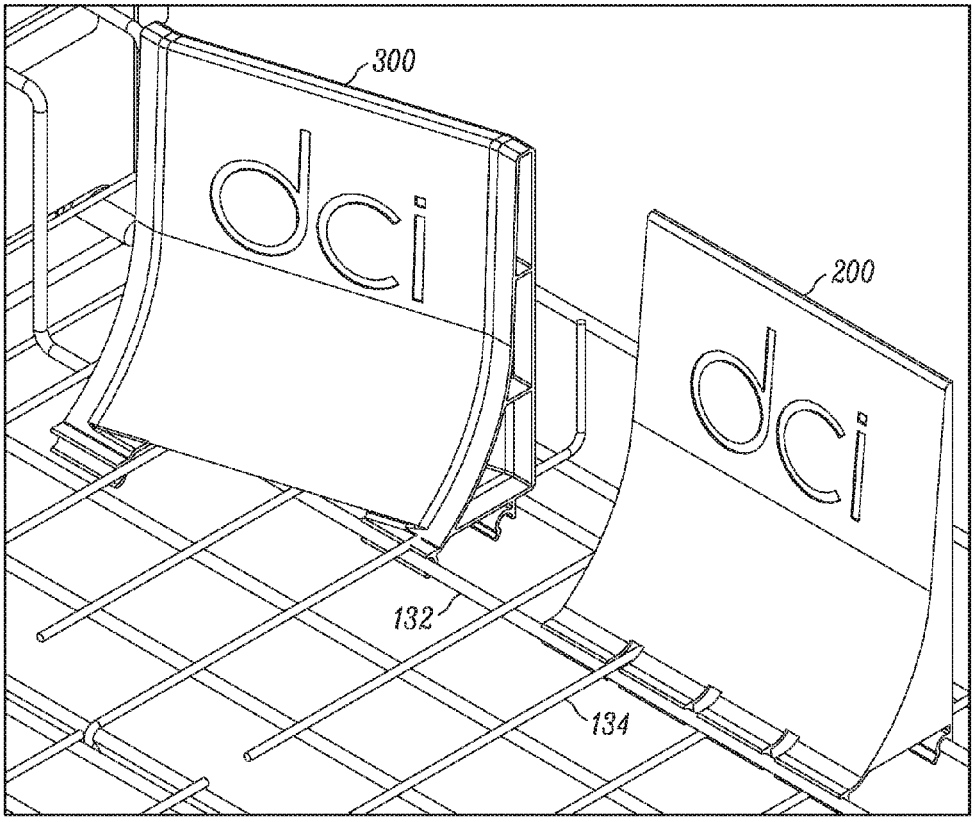
FIG. 4 shows an example of the backstop of FIG. 2 and the angled backstop of FIG. 3 engaging with a shelf of a shelving assembly.

FIG. 4 shows an example of the straight backstop 200 of FIG. 2 and the angled backstop 300 of FIG. 3 engaging with the rungs 132, 134 (in particular, with the lateral rungs 132) on a shelf 130 of a shelving assembly 100. The angled backstop 300 may have the configuration (or at least a similar construction) to the angled backstop shown in FIGS. 6A-E in U.S. Design patent application No. 29/554,176, which is hereby incorporated by reference in its entirety.

The backstops shown in FIGS. 2-4 may take on a variety of different configurations, shapes, and appearance. For example, the backstops may also take on the configuration of the backstops shown in FIGS. 5A-E U.S. Design patent application No. 29/554,176, which is hereby incorporated by reference in its entirety. For example, a straight backstop 200 may include two forward facing openings that extend from protrusions that define a space between the openings, as shown in FIGS. 5A-E of Design patent application No. 29/554,176. Backstops 201 having this configuration are shown in FIGS. 6A and 6B. Similarly, the angled backstop 300 may also include protrusions that defines a space between the various forward facing openings.

Further examples, embodiments, and applications of shelving units will now be described with exemplary references to the FIGS. 1A-1I and 2-4, and to the reference numbers therein. The described shelving unit 100 can be used to display merchandisable objects. In one example, the unit 100 includes a pair of side members, or brackets 110 that are configured to attach to a support structure 102 (e.g., a vertical support structure). Each side bracket 110 includes a slide channel 120. The slide channels 120 include a flat portion 122 toward a rear of the side bracket 110 and an angled portion 125 forward from the flat portion. The flat portion 122 can be generally flat when the side bracket 110 is installed with respect to the support structure 102. In other words, the flat portion 122 is generally parallel with the longitudinal axis of the side bracket 110. The unit 100 also includes a shelf 130 that slides along the side brackets 110 between a retracted position and an extended position. The shelf 130 includes a rear tray 140 with a support mechanism 146 that supports the rear tray 146 on the side brackets 110. The rear tray 140 is configured to slide along the pair of side brackets 110 between the open and retracted position. The shelf 130 also includes a front tray 150 hinged to the rear tray. The front tray 150 has side arms 160 that extending along opposing side edges 156 of the front tray 150. The side arms 160 extend beyond a rear edge 154 of the front tray 150 so that, when the front tray 150 is parallel with the rear tray 140, the side arms 160 extend over or at least partially overlap the rear tray 140. The side arms 160 have a sliding mechanism 162 (e.g., a wheel, bearing, bushing, slider, etc.) that can slide within the slide channels 120 of the side brackets 110. The front 150 tray is hinged so that it can pivot with respect to the rear tray. The shelf 130 is hinged so that when the shelf 130 is in the retracted position, the front tray 150 and the rear tray 140 are generally parallel, and the sliding mechanisms 162 of the side arms 160 are within the flat portion 122 of the slide channels 124. When the shelf 130 is in the extended position, the sliding mechanism 162 of the side arms 160 travels into the angled portion 125 of the slide channels 124, thereby allowing the front tray 150 to pivot with respect to the rear tray 140. For example, in the extended position, the front tray 150 can pivot downward, thereby facilitating the stacking of product (e.g., salty snacks) on the shelf.

In some examples, the support mechanism 146 of the rear tray 140 is configured to rest and slide upon an upper surface 116 of the side brackets 110. The support mechanism 146 comprises a bushing configured to reduce friction between the rear tray 140 and the upper surface 116 of the side brackets 110. The support mechanism 146 may include a first and second support mechanism positioned on opposite sides of the rear tray 140.

In some examples, each side bracket 110 further comprises an insertion channel 126 forward of the slide channels 124, the insertion channel 126 having a receiving portion 128 at a front end 112 of the side bracket 110, the receiving portion 128 configured to receive the slide mechanism 162 of the side arm 160 of the front tray 150. The insertion channel 128 can be on a different (e.g., a higher) plane than the flat portion 122 of the slide channel 124.

In some examples, the shelving unit 100 comprises a biasing mechanism configured to bias the shelf in the retracted position. The biasing mechanism is configured to enable sliding of the shelf 130 from the retracted position toward the extended position in response to a front portion 152 of the shelf lifting in a vertical direction with respect to the side brackets 110. The biasing mechanism can include a finger 175 projecting from a front portion of the front tray 150. The biasing mechanism can also include a support bar extending between front ends of the side brackets, wherein the finger 175 is configured to be located rearward of the support bar in the retracted position. In some examples the biasing mechanism comprises an indexed portion 123 toward the rear of the flat portion 122 of at least one slide channel, the indexed portion configured to removably secure the shelf in the retracted position.

In some examples, the shelf 130 comprises a brace 172 or support bar extending between the pair of side brackets 110. The brace 172 is configured to stay fixed with respect to the side brackets 110 as the shelf 130 slides between the retracted and extended positions. The brace may comprise a rolling mechanism 170 that facilitates the shelf 130 sliding across the brace 172.

In some examples, the shelf 130 is configured so that, in the extended position, the rear tray 140 remains fully supported by the side brackets 110. The rear tray 140 may have a depth $D_R$ that constitutes at least about one third of the depth D of the shelf. In some examples, the shelf 130 and side brackets 110 are configured so that the rear tray 140 travels generally parallel with respect to the side brackets 110 between the retracted and extended positions.

Some examples further include at least one backstop 200, 300 removably attachable to the shelf 130. In some examples, wherein the rear tray 140 comprises a grid of rungs 132, 134, and the backstop 200 is configured to attach to the shelf via at least one rung 132. The backstop 300 may have a font surface 320 that is non-parallel to the rungs 132, 134 of the grid. For example, a backstop 300 may have a front surface 320 and sides, wherein the front surface 320 and sides are not perpendicular to each other. In some examples, the backstop 200, 300 defines a first mating 250 structure at a forward portion of the backstop 200 and a second mating 260 structure at a rearward portion of the backstop.

In some examples, the front tray 150 is hinged to the rear tray 140 via at least one hinge hook 136 that extends from the rear tray 140 and hooks around a hinge bar 238 that extends along the rear edge 154 of the front tray 150. Alternatively, the hinge hook may extends from the front tray 150 and hooks around a hinge bar that extends along the front edge of the rear tray 140. The hinge hook 136 can include an open channel hook configuration. In some examples, the front tray 150 and rear tray 140 comprise a grid of rungs 132, 134, and the hinge hook 136 extends from a rung 134 of the rear tray 140 that extends generally parallel with the side brackets 110, and the hinge bar 138 is a rung of the front tray 150 that extends generally perpendicular to the side brackets 110.

In some examples, the side bracket 110 comprises a mounting mechanism 115 configured to mount the side bracket 110 to a support structure 102. The mounting mechanism 115 can include a plurality of tabs 113, 117, 119 configured to correspond to one or more slots on the support structure 102. One or more tab may have a notch 117 configured to provide lateral support that inhibits accidental removal of the side bracket 110 from the support structure 102. The side bracket may be configured to mount to the support structure 102 by angling a front end 112 of the bracket 110 higher than mounting mechanism 115 as the mounting mechanism 115 inserts into the one or more corresponding slots on the support structure 102.

Another example describes a pivoting shelf unit that allows a shelf to be inserted along an insertion track for installation purposes, but is configured in a manner that inhibits the shelf from passing back through the installation track after install. This helps inhibit unwanted or accidental removal of the shelf from the shelving unit comprising with a pair of side brackets. The side brackets can include an insertion passage defining a forward facing opening and a linear channel running along a longitudinal axis of the side bracket. The forward facing opening is configured to receive at least a portion of the shelf. The shelf has a shelf that can be similar to the hinged shelf described above. The flat portion of the non-linear channel extends at a different elevation (e.g., it is at a lower elevation) than the linear channel of the insertion passage to inhibit unwanted travel of the shelf from the rear passage to the insertion passage. In some examples, the opening comprises a notch that inhibits unwanted or accidental removal of the shelf from the side brackets.

The present disclosure also describes embodiments relating to a backstop 200 that can be installed or connected to a shelving display 100 (e.g., one or more of the exemplary shelving systems described herein). The backstops 200 can be used to position behind product displayed on a shelf. In one example, the backstop 200 comprises a front portion 210 with a product engaging surface 220. The backstop 200 has one or more first connectors 250 that have a forward facing opening 252 extending from the bottom 240 front of the backstop 200. The backstop 200 also has one or more second connectors 260 with a downward or partially downward facing opening 262 that extend from the bottom rear 230 of the backstop 200. The forward facing openings 252 are configured to allow the first connector 250 to connect to a first portion of the shelf 130 (e.g., snap onto a rung 132 of the tray) so that the backstop 200 can tilt with respect to the shelf 130. That is, a backstop 300 connected via one of the forward facing openings 252 can pivot about the connection point so that the rear 230 of the backstop 200 can tilt up and down with respect to the shelf 130. The downward facing openings 262 are configured to connect the second connectors 260 to a second portion of the shelf 130 (e.g., another rung of the tray) as the backstop 260 pivots about the first portion of the shelf 130 toward the rear of the shelf 130.

The downward facing opening 262 may have a bell mouth shape configured to guide the second rung into the at least partially downward facing opening. In some examples, the first connector 250 comprises a plurality of first connectors 250 extending from the bottom 240 of the front portion 210 of the backstop 210. Each of the first connectors 250 can have forward facing openings 252. The second connector 260 can also include a plurality of second connectors 260 extending from the bottom 250 of the rear 230 portion of the backstop 200. Each of the second connectors 260 have an at least partially downward facing opening 262. The first connectors 250 and second connectors 260 are each configured to connect to a rung of the grid of rungs.

The grid of rungs can include, for example, a plurality of parallel longitudinal 234 rungs positioned over or intersecting with a plurality of parallel transverse rungs 232. The transverse rungs 232 run generally perpendicular to the longitudinal rungs 234. The backstop 200 further comprises a recess 254 between each of the first connectors 250 and between each of the second connectors 260. The forward facing openings 252 and the at least partially downward facing openings 262 are configured to connect to a transverse rung 232. The spacers 254 are configured to straddle and/or receive a longitudinal rung 234 upon the backstop connecting to the shelf 230.

In some examples, the product engaging surface 320 is angled with respect to the front portion 310 so that the backstop 300 is configured to display a stack of products at an angle with respect to the shelf 130, the shelving unit 100, or to a forward facing plane of the shelf, shelving unit, mounting structure, or aisle in which the shelving unit 100 is positioned.

In some examples, a front connector 250 comprises a forward first connector 350*a* configured to connect to the first portion of the tray and at least one rearward first connector 350*b* configured to connect to a third portion of the tray, wherein the first portion of the tray is closer to the front of the tray than the third portion of the tray. In other examples, the at least one first connector comprises at least two connectors, with at least one connector positioned forward of the other connectors.

In some examples, the product engaging surface 220, 320 of the backstop 200, 300 is solid. The product engaging surface 220, 230, may include indicia 222, 322 for customizing the backstop.

Some embodiments relate to a bracket 110 that mounts to a support structure 102 and supports a slideable shelf 130. The bracket 110 includes a rear portion 114 having a mounting mechanism 115 configured to attach to the support structure 102. The bracket 110 also includes an upper surface 116 configured to support the shelf 130 as the shelf 130 slides between a retracted and extended position along the bracket 110. The bracket includes a slide channel 120 that has an insertion passage defining a forward facing opening 128 and a linear channel 126 running along a longitudinal axis of the bracket 110. The slide channel 120 also includes a rear passage defining a non-linear channel 124 having a flat portion 122 that extends generally parallel to the longitudinal axis of the bracket 110 and an angled portion 125 that extends at an angle between the flat portion 122 of the rear passage 124 and the insertion passage 126. The slide channel 120 is configured to receive a portion of the shelf 130 so that, in the retracted position, the received portion of the shelf is within the flat portion 122 of the rear passage 124 and so that, in the extended position, the received portion of the shelf 130 is within the angled portion 125 of the rear passage 124. The insertion passage 126 is configured to receive the portion of the shelf 130 during installation of the shelf 130. The installation passage 126 is positioned in a higher plane than the flat portion 122 of the rear passage to inhibit the portion of the shelf 130 from entering the insertion passage 126 as the shelf 130 moves between the retracted and extended position.

In some examples, the mounting mechanism 115 comprises a plurality of tabs configured to correspond to one or more slots on the support structure 102. The mounting mechanism 115 can include a plurality of tabs 113, 117, 119 configured to correspond to one or more slots on the support structure 102. One or more tab may have a notch 117 configured to provide lateral support that inhibits accidental removal of the side bracket 110 from the support structure 102. The side bracket may be configured to mount to the support structure 102 by angling a front end 112 of the bracket 110 higher than mounting mechanism 115 as the mounting mechanism 115 inserts into the one or more corresponding slots on the support structure 102.

Some examples described herein present a hinged drawer type shelving unit 100 comprising a shelf 130 having a first portion 150 and a second portion 140 hinged to the first portion. The first portion 150 is connected between opposing arms 160 with each arm 160 having a guide 162 connected to a rearward portion of the arm 160. The unit 100 and a frame 102 having opposing side brackets 110 between which the shelf 130 is disposed, each side bracket 110 defines a travel passage 124 for directing or guiding movement of the corresponding guide 162 as the shelf is moved between a first stored position wherein the first 150 and second 140 shelf portions are coplanar with one another and a second extended position to simplify restocking of product on the shelf 130 wherein the first 150 shelf portion is tilted and non-coplanar with the second shelf portion 140.

In some examples, the side brackets 110 define an installation passage 126 for receiving the corresponding guide 162 of each arm 160 to install the shelf 130 on the frame 102. The installation passage 126 may intersect the travel passage 122 to position the guide 162 of each arm 160 in the travel passage 124 once the shelf 130 is installed. In some aspects, the travel passage 124 is angled with respect to the installation passage 126 to tilt the shelf 130 as it is moved from the first position to the second position so that the first shelf portion 150 angles downward from the plane containing the second shelf portion 140. The travel passage 124 has a first linear passage 122 that maintains the first shelf portion 150 coplanar to the second shelf portion 140 as the guide is in the first linear portion 122 and a second linear 125 portion that is angled with respect to the first linear portion 122 that maintains the first shelf portion 150 in the non-coplanar position with respect to the second shelf portion 140.

In some embodiments, the opposing side brackets 110 of the frame 102 have generally flat upper surfaces 116 and the second shelf portion 140 has a generally U-shaped cross section with a central base portion 147. Upstanding side portions 144 may extend from the central base portion 147. The upstanding side portions 144 have distal ends and support members 146 proximate the distal ends that support the second shelf portion 140 on the generally flat upper surfaces 116 of the opposing side brackets 110 of the frame 102. The support members 110 may include a bushing 146 made of a friction reducing material to assist in movement of the second basket portion 140 as the shelf 130 is moved between the first and second positions.

The side brackets 110 can include a friction reducing member 170 positioned proximate a forward end 112 of each side bracket 110 to assist with movement of the shelf 130 between the first and second positions. In some approaches, at least one arm 175 defines a stop protruding from a surface thereof for engaging the friction reducing member 170 positioned proximate the forward end 112 of the side bracket 110 to hinder inadvertent movement of the shelf 130 from the first position to the second position. The friction reducing member 170 can be a roller rotatable with respect to the side bracket 110 and rotates as the arm 175 rides on top of the roller 170 to assist movement of the arm 175 along the side bracket 110. In some examples, the guide 162 is connected to the rearward portion of the arm 160 is a roller disposed within the travel passage 122 of each side bracket 110.

Figure 5:
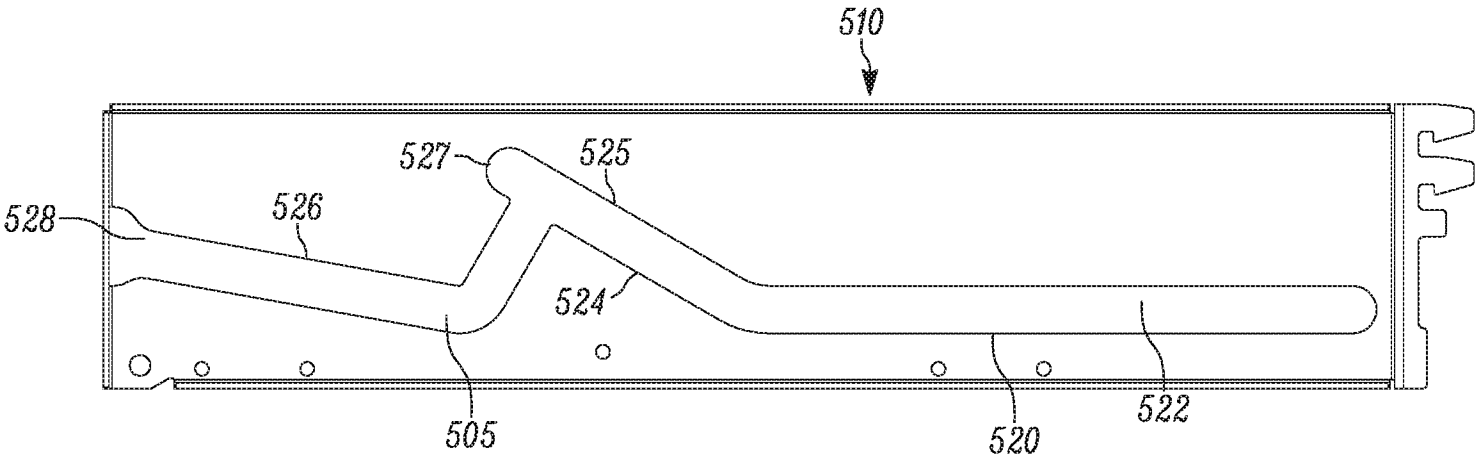
FIG. 5 shows another example of a side bracket component that can be used with a shelving unit in accordance with examples described herein.
Figure 6A:
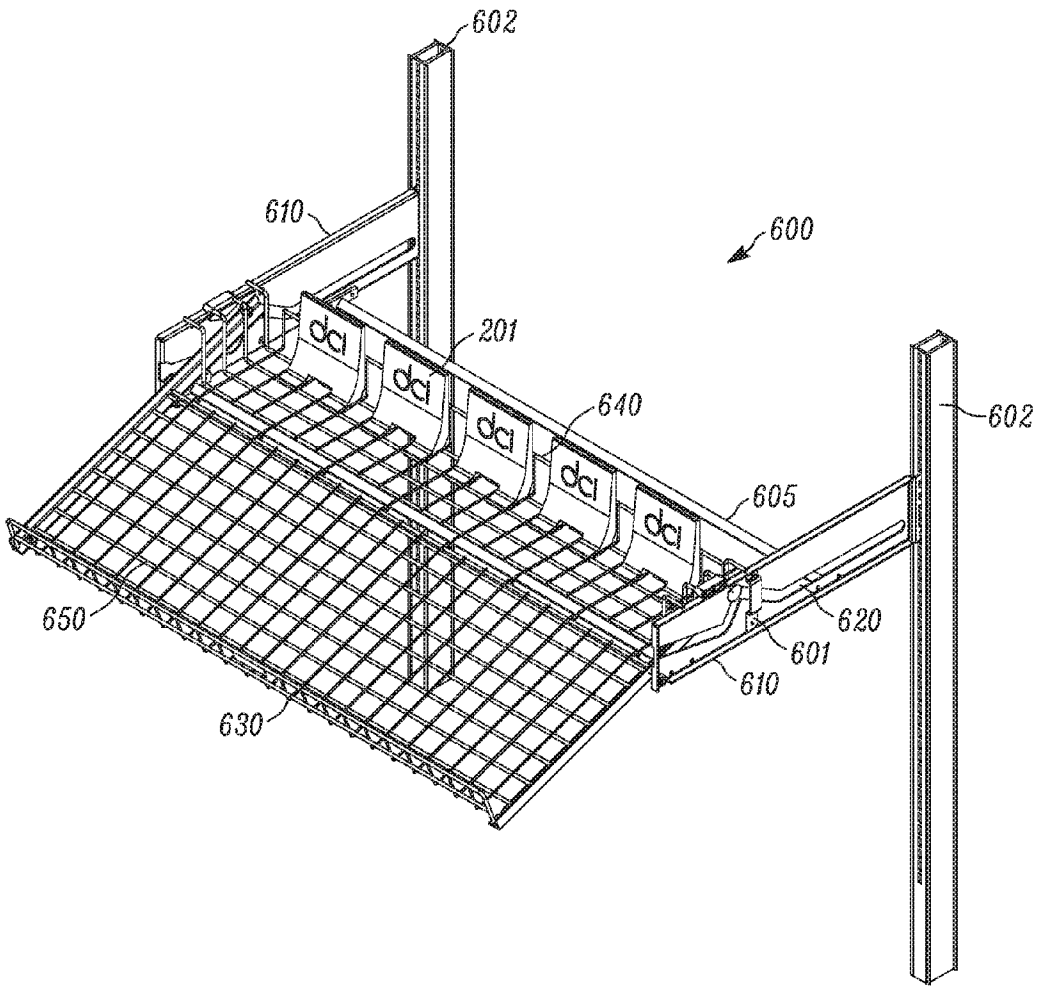
FIGS. 6A-B are perspective and enlarged views, respectively, of an alternate embodiment in accordance with the invention.
Figure 6B:
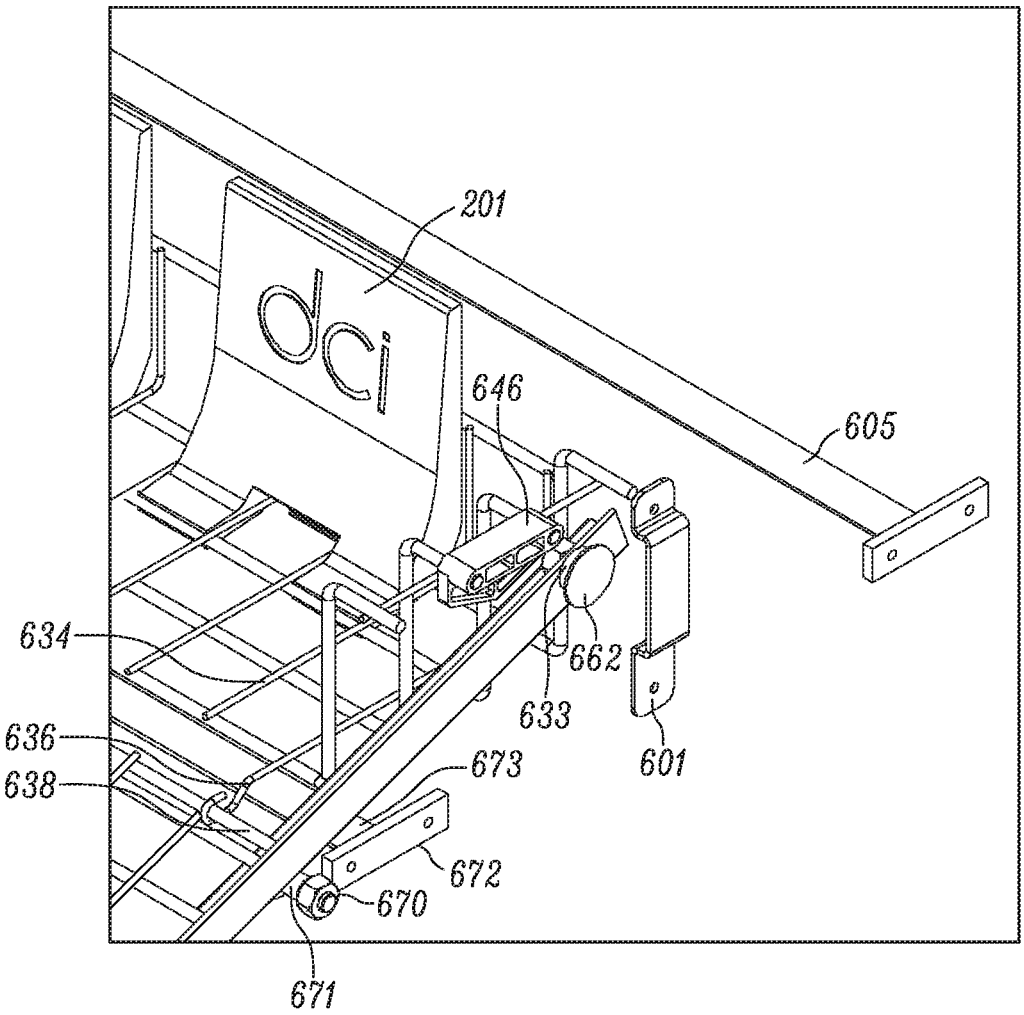

FIG. 5 shows another example of a side bracket 510 that can be used with a shelving unit 100 in addition to or in place of the shelving unit 110 of FIG. 1F. In particular, FIG. 5 provides detail regarding the shape and structure of the channel 520 of the side bracket 510. Side bracket 510 may have the configuration (or at least a similar construction) of one or more of the side brackets shown in FIGS. 1A-3B (and in particular, in FIGS. 1D, 1E, 2D, 2E, and 3A-C) in U.S. Design patent application No. 29/554,176, which is hereby incorporated by reference in its entirety.

The side bracket 510 is similar to the side bracket 110 of FIG. 1F, with the exception that the channel 520 has a different configuration to that of channel 120 in FIG. 1F. In particular, the insertion portion 526 of channel 520 differs slightly from the insertion portion 126 of channel 120 of the side bracket 110 of FIG. 1F. Unlike insertion portion 126 of FIG. 1F, which extends linearly in a direction generally parallel to the flat portion 122 of the channel 120, the insertion portion 526 of channel 520 drops downward before extending back up toward the opening 528. In this way, the side bracket 510 provides a distinguished insertion passage 526 that may facilitate insertion of a shelf (e.g., shelf 130) in certain situations. The insertion portion 526 includes an elbow 505 that angles upward, back to the angled portion 525 of the rear passage 524, which transitions to the flat portion 522 at the back of the side bracket 510. The angled portion 525 comprises an angled end stop 527 upon which a portion of the shelf situates while the shelf 130 is in the extended position. In this way, the angled end stop 527 is formed intermediate the channel opening 528 and the enclosed end of channel 520 proximate flat section 522.

FIGS. 6A-B illustrate yet another alternate embodiment in accordance with the invention. In keeping with prior practice, items that are similar to those discussed above in prior embodiments will be referenced using the same latter two-digit reference numerals, but use the prefix 6 to distinguish one embodiment from the others. Thus, in FIGS. 6A-B, the shelving unit will be referred to generally by reference numeral 600 and the sliding shelf 630 and side walls 610, which are configured to connect to support structure 602 (e.g., vertical uprights, gondola uprights, a support wall, etc.). Specifically, FIG. 6A shows an isometric view of a shelving unit 600, and FIG. 6B shows a close up view of the shelving unit 600 in an extended position with the side arm 620 removed so that various components can be seen more clearly.

The shelving unit 600 has a support mechanism 646 that includes an inverted L shaped nylon guide or wear strip that travels along upper and side surfaces of the side wall 610. The support mechanism 646 is shown as spanning between two bars on the rear tray 640, but it should be understood that the support mechanism can span 3, 4, or more bars, depending on the intended use. It also includes an alternate bushing 662 for traveling in channel 620. As shown, the bushing 662 does not include a screw-head or tightening mechanism, and includes a spacer portion 633 that helps assure that the bushing 662 maintains a wide enough surface upon which to slide in channel 620.

The shelving unit 600 also includes a support member 670 (e.g., pivot point, friction reduction member, wear member, etc.) that has an alternate configuration to that of other embodiments. Notably, the support member 670 comprises a bolt that includes a support surface that can provide support for the front tray 650 (i.e., the hinged portion) of the shelf 630 in the extended position. The support member 670 is similar to first reinforcement member or brace 672. The shelving unit 600 also has a second reinforcement member, or brace 601 that has an alternate configuration to that of other embodiments, and that helps to inhibit bowing or deflecting of the shelving unit during assembly, thereby inhibiting the likelihood that the shelf 630 will experience increased friction during movement, or slide out of the channel 620. The shelving unit also includes a back bar 605, or brace, that provides further support and stability to the configuration of the shelving unit.

FIGS. 6A and 6B also show an alternate hinge configuration. As shown, the hinge configuration includes an inverted hook 636 that has an upward facing opening that interacts with, and surrounds the bar 638 on the front tray 650. In this manner, the shelf 630 can easily be installed in the shelving unit 600 by first installing the front tray 650 into the side brackets 610, then placing the rear tray 640 onto the shelving unit by resting the rear tray 640 on the side brackets 610, and then pivotably connecting the rear tray 640 to the front tray 640 by looping the inverted hooks 636 around the bars 638 of the front tray 650. The inverted hooks 636 are configured with a bend so that not only will pulling the front tray 650 cause the rear tray 640 to extend toward open, but also so that pushing the front tray 650 rearward will move the rear tray 640 rearward without causing the bar 638 to escape from the hooks 636. The inverted hook hinge configuration provides various advantages. For example, the inverted hook configuration makes it easier to connect the front tray 650 and the rear tray 640 during assembly. This inverted hook hinge configuration also reduces risk that the front and rear trays 650 and 640 will become disengaged during operation. Further, the inverted hook hinge configuration makes it less likely that objects stored on shelves below the shelf 630 (e.g., bags of product) will catch or snag on the hook 636 when the shelf 630 is extended to an open position because the hook 636 faces a direction opposite to that of the motion of travel during the opening of the shelf 630.

In addition to the above identified apparatus embodiments, it should also be understood that numerous methods are also disclosed herein that allow a rear portion of the shelf to remain in one orientation or plane while allowing a front portion of the shelf to move to another orientation or plane (e.g., angle downward) for restocking purposes so as to reduce the risk of damaging product positioned at the rear of the shelf. For example, methods for manufacturing and methods for assembling a shelf system are disclosed herein, as are methods for moving a shelf between a first position and a second position (e.g., extending, tilting or extending and tilting a shelf, etc.). Methods for inserting a shelf and guiding a shelf along its regular limits of travel are also all disclosed herein. In a more specific example, a method of installing a shelf is disclosed herein including the steps of installing side members (110, 510, 610) on a display, connecting a front product support (150, 650) to the installed side members (110, 510, 610), and connecting a rear product support (140, 640) to the front product support (150, 650).

In some forms, the installation of the side members (110, 510, 610) includes installing side members (110, 510, 610) interconnected by at least one brace (172, 672, 605) on the display. Similarly, connecting the front product support (150, 650) includes installing guides (162, 662) extending from the front product support (150, 650) into mating channels (120, 520, 620) of the side members (110, 510, 610). Connecting the rear product support (140, 640) may include pivotally or hingedly connecting the rear product support (140, 640) to the front product support (150, 650) after the front product support (150, 650) has been connected to the installed side members (110, 510, 610). Likewise, the installation method may also include moving the front and rear product supports between a first position wherein the product supports are generally coplanar with one another and a second position wherein the front product support (150, 650) is angled downward from the plane containing the rear product support (140, 640) so that the planes containing the front and rear product supports are transverse to one another.

In some forms, such a method of installation may include installing two side members or brackets onto opposing sides of a shelving unit, then connecting a front tray to the side brackets, and subsequently connecting a rear tray with the front tray to form a pivotably sliding shelf. The side brackets may be installed by inserting tabs on a rear edge of the side brackets into corresponding slots in a vertical support structure of the shelving unit. In some forms, the side brackets may be interconnected by one or more braces of the shelving unit, which can provide structural stability to the shelving unit. The side arms may have a slide channel adapted to receive a slider on a front tray, such as the front tray 110 and 610 described herein. A user may install the front tray onto the shelving unit by inserting a slider or guide that extend from the front tray into the slide channel in the side brackets. The slider or guide can then be moved into an angled portion of the slide channel so that the front tray rests in a lowered, angled position that corresponds with an open or loading position. The rear tray or rear basket can then be installed onto the side brackets of the shelf. Support mechanisms on opposing sides of the rear tray may be placed to rest upon the upper surfaces of the two opposing side brackets. In some forms, bushings or sliders may be installed, snapped, or otherwise engaged with the top surface of the side brackets. The rear tray may then be attached to the front tray in a hinged or pivotable manner that allows the front tray to rotate vertically with respect to the rear tray to facilitate loading of the shelf. For example, a hooks on the rear tray may be looped around a bar on the front tray, thereby attaching the trays while allowing the front tray to pivot with respect to the rear tray. In this way, when the shelf is in an open or loading position, the first tray may be hinged downward from the generally horizontal rear tray to present an angled working surface to a user that faces the shelf. Once connected, the front and rear trays form a shelf that can slide and move together as a single shelf, while still allowing the front tray to pivot downwards so that user may be able to load the shelf. Once installed, the front and rear trays can be moved together as a single shelf between a first or closed position, where the front and rear trays are generally co-planar with one another, and a second position (or an open or loading position) where the front tray is angled downward from the plane containing the rear tray, so that the planes of the front and rear trays are transverse to one another. In some forms, the front tray may first be hinged to the rear tray before it is inserted into the slide channel of the side brackets. In other forms, the rear tray may be installed onto a side bracket before the front tray, and the two trays can be hingedly attached either simultaneously with or subsequent to the installation of the front tray on the shelving unit.

Some methods also include use of an installed shelving unit, such as the variety of shelving units described herein. In one example, a shelf is originally in a closed or stored position. The shelf includes a front tray hingedly attached to a rear tray. A user pulls on the shelf from the stored position toward a first open position by tugging on the front tray. As the shelf extends from the closed position, guides in the shelf slide along a horizontal portion of a channel in side arms of the shelving unit. In a first open position, at least a part of the front tray extends away from side arms in the shelving unit, while the rear portion of the tray remains generally between the side arms. In this first open position, the front tray is generally parallel and co-planar with the rear tray. Next, the front tray is rotated downward from the first position to a second position, or a loading position. A guide that extends rearward from the front tray remains in the slide channel in the side arm, and travels into an angled portion of the slide channel. This allows the front tray to pivot downward to the second or loading position, which loading position facilitates the user's ability to load the shelf. After loading the shelf, the user can push the tray back to the closed position by first lifting the front tray to the horizontal or first open position, which brings the guide of the first tray toward a horizontal portion of the slide channel, and then pushing the shelf rearward, toward the closed position.

The present disclosure describes preferred embodiments and examples of the present technology. Those skilled in the art will recognize that a wide variety of modifications, alterations, and combinations can be made with respect to the above described embodiments without departing from the scope of the invention as set forth in the claims, and that such modifications, alterations, and combinations are to be viewed as being within the ambit of the inventive concept. In addition, it should also be understood that features of one embodiment may be combined with features of other embodiments to provide yet other embodiments as desired. Thus, although one feature may have only been described with one embodiment, it should understood that utilization of such a feature on any of the other embodiments disclosed herein is also contemplated. All references cited in the present disclosure are hereby incorporated by reference in their entirety.

The invention claimed is:

1. A shelving unit comprising:

a pair of side brackets each comprising a slide channel, each slide channel comprising a flat portion toward a rear of the side bracket and an angled portion forward of the flat portion, the pair of side brackets configured to attach to a support structure;

a shelf that slides along the pair of side brackets between a retracted position and an extended position, the shelf comprising:

a rear tray having a support mechanism supporting the rear tray on the pair of side brackets, the rear tray configured to slide along the pair of side brackets as the shelf is moved between the retracted position and extended position; and a front tray hinged to the rear tray, the front tray comprising side arms extending along opposing side edges of the front tray, the side arms extending beyond a rear edge of the front tray, each side arm having a sliding mechanism configured to slide along the slide channels of the side brackets;

wherein the front tray is hinged to pivot with respect to the rear tray so that, in the retracted position, the sliding mechanisms of the side arms are within the flat portion of the slide channels and the front tray and the rear tray are generally parallel, and so that, in the extended position, the sliding mechanism of the side arms are in the angled portion of the slide channels and the front tray is pivoted with respect to the rear tray.

2. The shelving unit of claim 1, wherein each side bracket further comprises an insertion channel forward of the slide channel, the insertion channel having a receiving portion at a front end of the side bracket, the receiving portion configured to receive the sliding mechanism of the side arm of the front tray.

3. The shelving unit of claim 2, wherein the insertion channel is on a higher plane than the flat portion of the slide channel to inhibit unwanted removal of the shelf from the pair of side brackets.

4. The shelving unit of claim 1, further comprising a biasing mechanism configured to bias the shelf in the retracted position, wherein the biasing mechanism is configured to enable sliding of the shelf from the retracted position toward the extended position in response to a front portion of the shelf lifting in a vertical direction with respect to the pair of side brackets.

5. The shelving unit of claim 4, wherein the biasing mechanism includes a finger projecting from a front portion of the front tray.

6. The shelving unit of claim 5, wherein the biasing mechanism further comprises a support roller, wherein the finger is configured to be located rearward of the support roller in the retracted position.

7. The shelving unit of claim 5, wherein the biasing mechanism comprises an indexed portion toward a rear of the flat portion of at least one of the slide channels, the indexed portion configured to removably secure the shelf in the retracted position.

8. The shelving unit of claim 1, wherein the shelf further comprises a brace extending between the pair of side brackets, the brace configured to stay fixed with respect to the pair of side brackets as the shelf slides between the retracted and extended positions.

9. The shelving unit of claim 1, wherein the shelf is configured so that, in the extended position, the rear tray remains fully supported by the pair of side brackets, and wherein the rear tray has a depth that constitutes at least about one third of a depth of the shelf.

10. The shelving unit of claim 1, further comprising at least one backstop removably attachable to the shelf, wherein the rear tray comprises a grid of rungs, and wherein the at least one backstop is configured to attach to the shelf via at least one of the rungs.

11. The shelving unit of claim 10, wherein the at least one backstop has a font surface that is non-parallel to the rungs of the grid.

12. The shelving unit of claim 10, wherein the at least one backstop defines a first mating structure at a forward portion of the at least one backstop and a second mating structure at a rearward portion of the at least one backstop.

13. The shelving unit of claim 1, wherein the front tray is hinged to the rear tray via at least one hinge hook that extends from the rear tray and hooks around a hinge bar that extends along the rear edge of the front tray.

14. The shelving unit of claim 13, wherein the front tray and the rear tray comprise a grid of rungs, wherein the at least one hinge hook extends from a rung of the rear tray that extends generally parallel with the side arms, and wherein the hinge bar is a rung of the front tray that extends generally perpendicular to the pair of side brackets.

15. The shelving unit of claim 13, wherein the at least one hinge hook defines an opening with a central axis around which the at least one hinge hook extends, the central axis being generally perpendicular to the pair of side brackets.

* * * * *